US010252097B1

(12) United States Patent
Raines

(10) Patent No.: US 10,252,097 B1
(45) Date of Patent: Apr. 9, 2019

(54) WEIGHTED ARTICLE WITH QUICK FILL AND HAMMOCK DAM CLOSURE

(71) Applicant: Mark T. Raines, Austin, TX (US)

(72) Inventor: Mark T. Raines, Austin, TX (US)

(73) Assignee: Mark T. Raines, Austin, TX (US)

( * ) Notice: Subject to any disclaimer, the term of this patent is extended or adjusted under 35 U.S.C. 154(b) by 187 days.

(21) Appl. No.: 14/920,871

(22) Filed: Oct. 22, 2015

Related U.S. Application Data

(60) Provisional application No. 62/066,918, filed on Oct. 22, 2014.

(51) Int. Cl.
*A63B 21/06* (2006.01)
*A63B 23/12* (2006.01)

(52) U.S. Cl.
CPC ..... *A63B 21/0603* (2013.01); *A63B 23/12* (2013.01)

(58) Field of Classification Search
CPC ..... A63B 21/0603
USPC ..... 383/61.1–61.3, 93, 95, 97
See application file for complete search history.

(56) References Cited

U.S. PATENT DOCUMENTS

| | | | | |
|---|---|---|---|---|
| 172,039 | A | 1/1876 | Lazarevitch | |
| 177,749 | A | 5/1876 | Redden | |
| 1,089,279 | A | 3/1914 | Simer et al. | |
| 1,909,921 | A | 5/1933 | Tompkins | |
| 2,616,467 | A | 11/1952 | William | |
| 2,622,646 | A | 12/1952 | Miller | |
| 2,696,342 | A | 12/1954 | William | |
| 2,795,425 | A | 6/1957 | Francis | |
| 2,918,282 | A | 12/1959 | Waterval | |
| 3,144,197 | A | 8/1964 | Milner et al. | |
| 3,181,439 | A | 5/1965 | Flax | |
| 3,255,927 | A | 6/1966 | Ruppert, Jr. et al. | |
| 3,528,652 | A | 9/1970 | Tarbox | |
| 3,998,304 | A * | 12/1976 | Edgerton, Jr. | A45C 3/00 190/107 |
| 4,062,392 | A | 12/1977 | Ishii | |
| 4,420,275 | A | 12/1983 | Ruser | |
| 4,685,890 | A | 8/1987 | Edwards | |
| 4,707,873 | A | 11/1987 | A-Van | |
| 4,846,464 | A | 7/1989 | Jorno | |
| 4,952,190 | A | 8/1990 | Tarnoff et al. | |
| 5,332,185 | A | 7/1994 | Walker, III | |
| 5,476,067 | A | 12/1995 | Queen et al. | |

(Continued)

FOREIGN PATENT DOCUMENTS

| | | | |
|---|---|---|---|
| CA | 624701 | A | 1/1961 |
| WO | 2004038133 | A1 | 5/2004 |

OTHER PUBLICATIONS

PCT/US09/52003 Search Report dated Sep. 22, 2009, 2 pages.

*Primary Examiner* — Jennifer M Deichl
(74) *Attorney, Agent, or Firm* — John A. Fortkort; Fortkort & Houston PC

(57) ABSTRACT

An article (600) is provided which includes a body (500) having an interior volume (100), and hook (124) and loop (125) features which, when pressed closed in at least one locations (130, 131) location, creates a dynamic hammock dam (132) that retains a fill material (140) that has been inserted into the interior volume. The strength of the hammock dam increases with outward pressure (141) applied on the closure by the fill material. The article is preferably equipped with a large mouth opening (110) which allows rapid filling or emptying of the fill material from the internal volume.

20 Claims, 29 Drawing Sheets

(56) References Cited

U.S. PATENT DOCUMENTS

| | | | | |
|---|---|---|---|---|
| 5,704,883 | A | 1/1998 | Eckmann | |
| 5,718,655 | A | 2/1998 | Phillips | |
| 5,848,946 | A | 12/1998 | Stillinger | |
| 6,099,441 | A | 8/2000 | Bonnet | |
| 6,149,555 | A * | 11/2000 | Kinback | A63B 21/06 383/10 |
| 6,149,557 | A | 11/2000 | Williams et al. | |
| 6,186,701 | B1 | 2/2001 | Kempers | |
| 6,224,517 | B1 | 5/2001 | Dereszynksi | |
| 6,261,211 | B1 | 7/2001 | Suarez et al. | |
| 6,969,195 | B2 | 11/2005 | Ferranda | |
| 7,713,180 | B2 | 5/2010 | Wickens et al. | |
| 7,891,914 | B2 | 2/2011 | Smallwood et al. | |
| 8,622,877 | B2 | 1/2014 | Raines et al. | |
| 2002/0090265 | A1* | 7/2002 | Merten | E02B 3/127 405/18 |
| 2004/0008909 | A1* | 1/2004 | Shepard | B65B 61/188 383/203 |
| 2004/0072660 | A1 | 4/2004 | Mercuri et al. | |
| 2006/0063653 | A1 | 3/2006 | Wickens et al. | |
| 2010/0022361 | A1 | 1/2010 | Raines et al. | |
| 2011/0287904 | A1 | 11/2011 | Morris | |
| 2012/0149536 | A1* | 6/2012 | Trimble | A63B 21/00065 482/93 |
| 2014/0113778 | A1 | 4/2014 | Raines et al. | |

* cited by examiner

- PRIOR ART -

- PRIOR ART -

- PRIOR ART -

WEIGHTED ARTICLE WITH QUICK FILL AND HAMMOCK DAM CLOSURE

CROSS-REFERENCE TO RELATED APPLICATIONS

This application claims the benefit of U.S. Provisional Application No. 62/066,918, filed Oct. 22, 2014, having the same title, and which is incorporated herein by reference in its entirety.

FIELD OF THE DISCLOSURE

The present disclosure relates generally to weighted articles such as sand bags, and more particularly to weighted and/or sealed articles which provide for quick filling and a secure closure.

BACKGROUND OF THE DISCLOSURE

Various sand bags and other weighted articles are known to the art, and are utilized for various purposes. For example, weighted articles are commonly used to hold down lighting equipment on movie sets, as flood barriers, and as makeshift fortifications for soldiers.

Sand bags and other weighted articles are also commonly used by athletes to develop strength, speed, and stamina. For example, U.S. Pat. No. 8,622,877 (Raines et al.), entitled "Weighted Article With Fill Spout", and U.S. 2014/0113778 (Raines et al.), entitled "Weighted Article With Fill Spout", describe an article 101 (see FIGS. 39-41) which comprises a body 103 having an interior volume 113, and a collapsible inlet 105 which is in open communication with said interior volume and which is movable from a first position in which it extends from said body, to a second position in which it extends into said internal volume. U.S. 2011/0287904 (Morris) discloses a similar device.

SUMMARY OF THE DISCLOSURE

Figure 1:
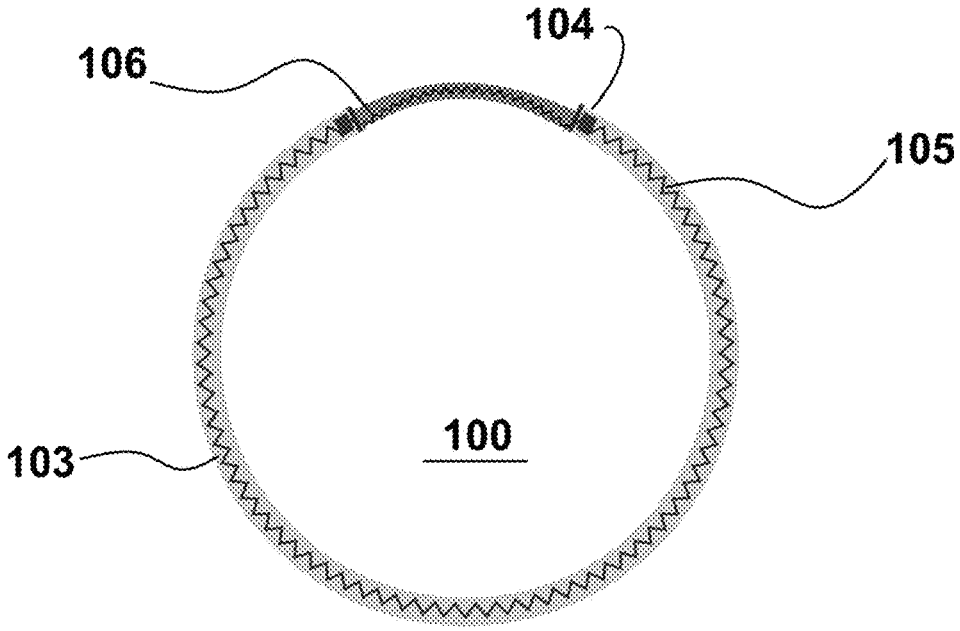
FIG. 1 is a top view of a first particular, non-limiting embodiment of a weighted article in accordance with the teachings herein.
Figure 2:
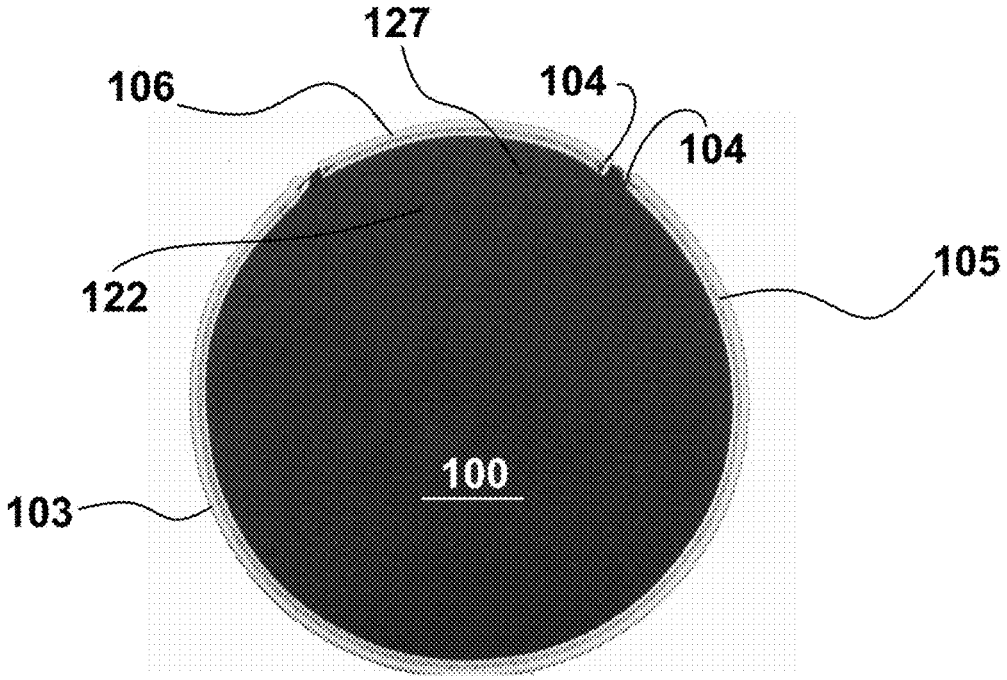
FIG. 2 is a top view perspective of a weighted article.

This section provides a general summary of the present disclosure, and is thus not intended to be a comprehensive disclosure of the full scope of the features of the devices and methodologies disclosed herein.

In one aspect, an article is provided which comprises (a) a body having first and second opposing walls and housing an interior volume; (b) a particulate or liquid filler disposed in said interior volume; (c) a dam disposed on an interior surface of said first wall; and (d) a releasable fastener having a first component disposed on a first surface of said dam, and a second component disposed on an interior surface of said second wall opposing said dam. The article is transformable between a first state in which said first and second components of said releasable fastener are spaced apart from each other such that said interior volume is in open communication with the environment external to the article by way of a channel which terminates in an external opening, and a second state in which said first and second components of said releasable fastener are releasably engaged to each other such that said interior volume is closed off from the environment external to said body.

In another aspect, a method is provided for creating a weighted article. The method comprises (a) providing an article having (i) first and second opposing walls and housing an interior volume, (ii) a dam disposed on an interior surface of said first wall; and (iii) a releasable fastener having a first component disposed on a first surface of said dam, and a second component disposed on an interior surface of said second wall opposing said dam, wherein said article is transformable between a first state in which said first and second components of said releasable fastener are spaced apart from each other such that said interior volume is in open communication with the environment external to the article by way of a channel which terminates in an external opening, and a second state in which said first and second components of said releasable fastener are releasably engaged to each other such that said interior volume is closed off from the environment external to said body; (b) positioning the article in the first state; (c) adding a filler to the internal volume by way of the channel and opening; and (d) transforming the article to the second state.

In a further aspect, an article is provided which comprises (a) a body having first and second opposing walls and housing an interior volume; (b) a releasable fastener having first and second components which are disposed in opposing relation on the interior surfaces of said first and second walls, respectively; and (c) a flexible chute having first and second opposing ends; wherein said article is transformable between a first state and a second state; wherein, when said article is in said first state, said flexible chute extends past said first and second components of said releasable fastener and to or through an opening in said body such that (i) the first and second openings of said chute are in open communication with each other, (ii) the first opening of said chute is in open communication with the atmosphere external to said body, and (iii) the second opening of said chute is in open communication with said interior volume; and wherein, when said article is in said second state, said first and second components of said releasable fastener are pressingly engaged with each other.

In still another aspect, a weighted article is provided which comprises (a) a plurality of panels which are joined across at least one seam by stitching; and (b) a coating which is disposed over said stitching.

DETAILED DESCRIPTION

While the weighted articles disclosed in U.S. Pat. No. 8,622,877 (Raines et al.), U.S. 2014/0113778 (Raines et al.) and U.S. 2011/0287904 (Morris) may have some desirable features, these articles also suffer from some infirmities. In particular, one of the purported advantages of these articles is that the filler can be added to or removed from them as desired. Consequently, these articles may be transported empty and then filled (or refilled) with a suitable filler (such as sand) on site, thus making them very light-weight and both inexpensive and easy to transport and handle.

However, in practice, the efficacy of the foregoing feature is significantly hindered by the speed with which these articles may be filled or emptied. In particular, the foregoing devices utilize relatively narrow fill spouts through which the filler is introduced or emptied. These fill spouts restrict the flow of filler into and out of the article, thus significantly lengthening the amount of time required to fill or empty the article. When it is considered that these articles are designed to be heavy when filled, this infirmity represents a significant handling challenge, since these articles have significant weight during most of the filling or emptying process.

Unfortunately, the foregoing problem cannot be readily solved by simply increasing the diameter of the fill spout. In particular, doing so significantly increases the stress on the fill spout and supporting fabric, and greatly increases the probability of filler leakage. The latter problem is highly objectionable to end users, since it introduces damaging grit into workout areas.

It has now been found that the foregoing issue may be addressed with the weighted articles disclosed herein. In a preferred embodiment, these articles feature a fillable body equipped with a hammock dam closure. Such a closure allows for a wide input/output mouth that is highly resistant to filler leakage, without unduly stressing adjacent portions of the fabric.

In a preferred embodiment, the articles disclosed herein utilize a releasable fastener, and more preferably a hook-and-loop type fastener (such as those sold under the tradename VELCRO™) to seal an aperture in the wall, edge or rim of the fillable body. The releasable fasteners allow for a large aperture, which amplifies the fill rate for both insertion and removal of fill into the body of the article. The hook-and-loop fasteners, which are preferably laminated to a neoprene or nylon sheet, are preferably sewn to the body of the article in such a way that when the aperture is closed, the seal becomes a dam. This dam becomes stronger with the increased shear pressure resulting from the fill material attempting to escape the sealed aperture. A secondary dam along the wall, edge or rim of the article will preferably be provided and may utilize a hook-and-loop fastener on materials connected to opposite sides of the body. This secondary dam preferably serves to keep fill materials inside the body, and to act as a barrier (via peel strength) to accidental opening of the article by an external operator.

Both releasable fastener closures may be quickly and repeatedly attached and detached without significantly compromising the closure. As such, the closures can be convenient and effective means for securing the fill contents.

Figure 8:
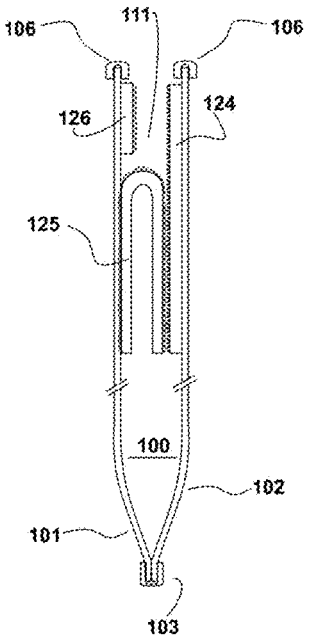
FIG. 8 is a cross-sectional view of the embodiment of FIG. 1, which is similar to FIG. 7, but which shows details of the semi-open aperture, detailing the connection between the Hammock Dam Loop and Hook.
Figure 9:
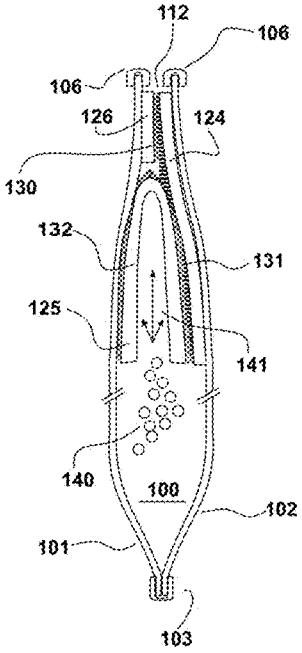
FIG. 9 is a cross-sectional view of the embodiment of FIG. 1, which is similar to FIG. 7, but which shows details of the fully closed aperture, detailing the connection between the Hammock Dam Loop and Hook, and the Peel Loop and Hook.
Figure 10:
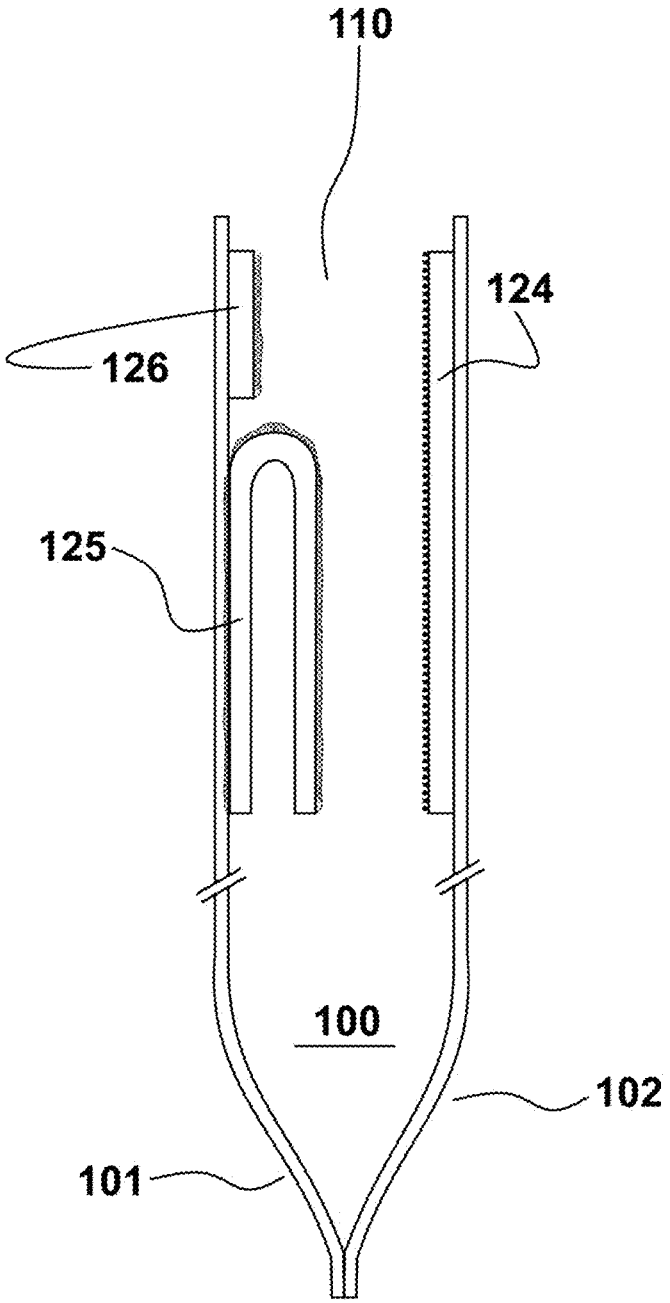
FIG. 10 is a cross-sectional view of the embodiment of FIG. 1, which is similar to FIG. 7, but which shows details of an embodiment which has no protective rim.
Figure 11:
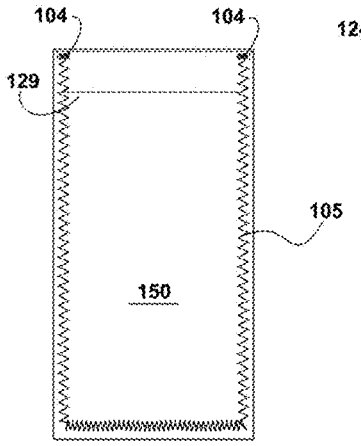
FIG. 11 is a top view of a second singular, non-limiting embodiment of a weighted article in according to exemplary embodiments of the present disclosure.
Figure 12:
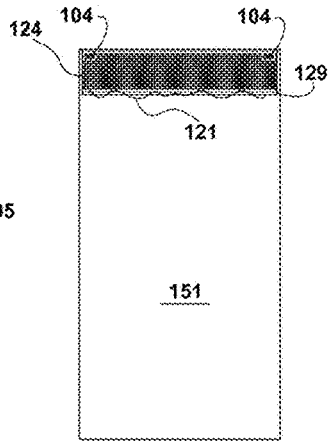
FIG. 12 is an internal view of the embodiment of FIG. 11 of the first portion of the weighted article, showing an embodiment of the hook fastener attachment and location.
Figure 13:
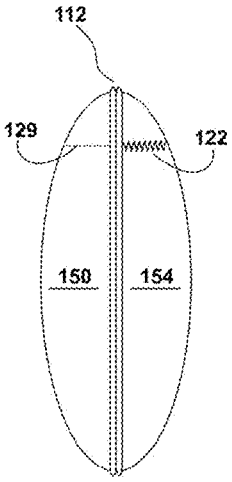
FIG. 13 is a side view of the embodiment of FIG. 11.
Figure 14:
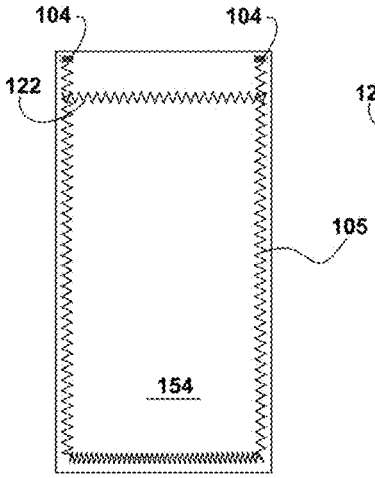
FIG. 14 is a bottom view of the embodiment of FIG. 11, which is a non-limiting embodiment of a weighted article in according to exemplary embodiments of the present disclosure.
Figure 15:
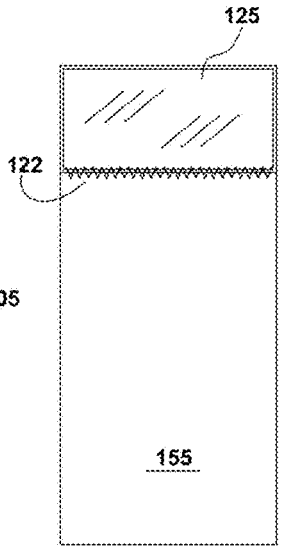
FIG. 15 is an internal view of the embodiment of FIG. 14 of the second portion of the weighted article, showing an embodiment of the loop fastener attachment and location which has not been sewn to the interior of the body of the article, detailing the non-loop side of the loop fastener.
Figure 16:
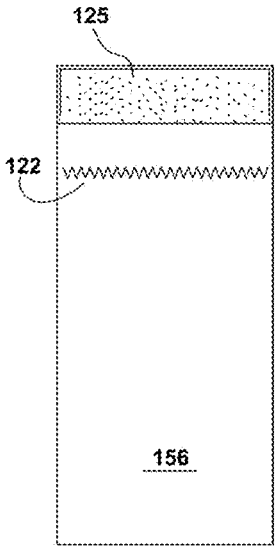
FIG. 16 is an external view of the embodiment of FIG. 14 of the second portion of the weighted article, showing an embodiment of the loop fastener attachment and location which has not been sewn to the interior of the body of the article, detailing the loop side of the loop fastener.
Figure 17:
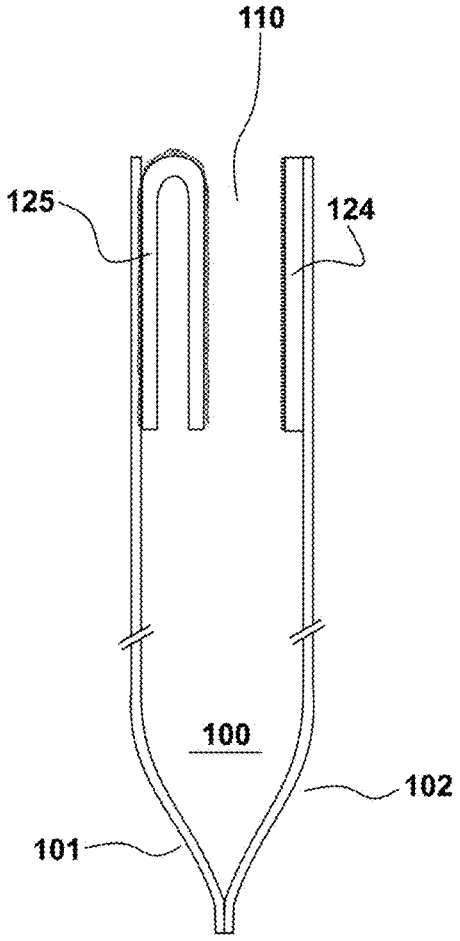
FIG. 17 is a cross-sectional view of the embodiment of FIG. 11, which shows details of the open aperture, Hammock Dam Loop location and Hook Location.
Figure 18:
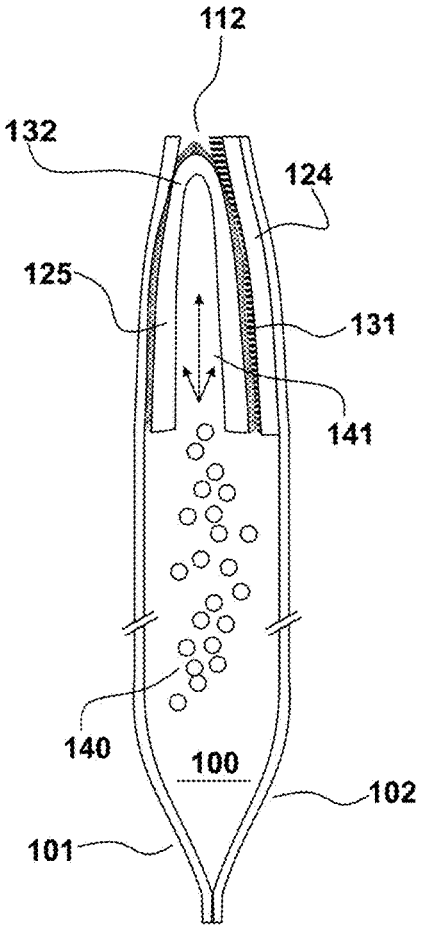
FIG. 18 is a cross-sectional view of the embodiment of FIG. 11, which shows details of the fully closed aperture, and details the connection between the Hammock Dam Loop and Hook, and the deformation of the Hammock Dam.
Figure 19:
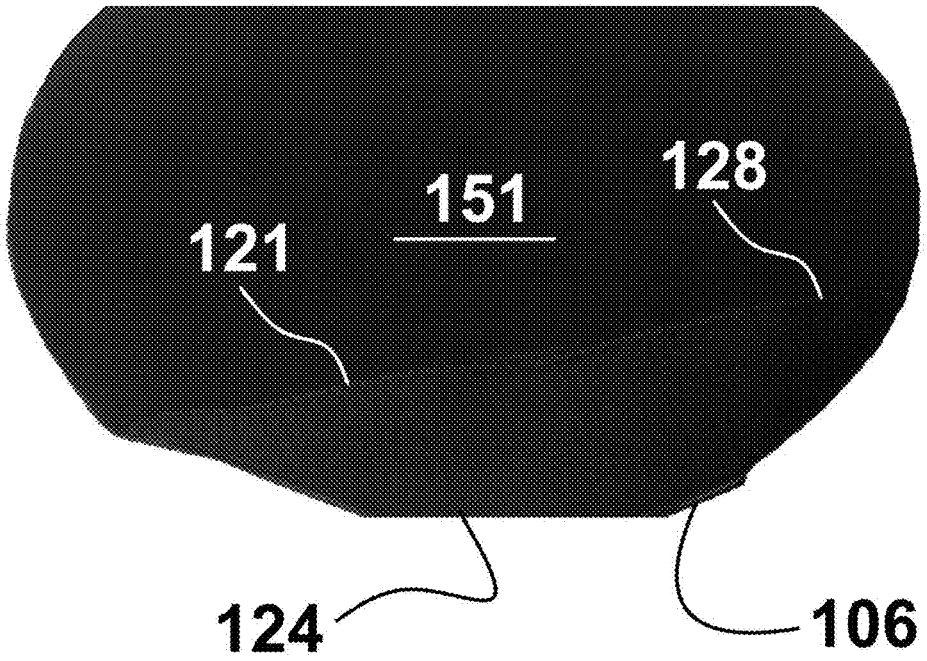
FIG. 19 is an internal view of the embodiment of FIG. 1, showing an embodiment of the hook fastener attachment and location, and the protective rim along the aperture.
Figure 20:
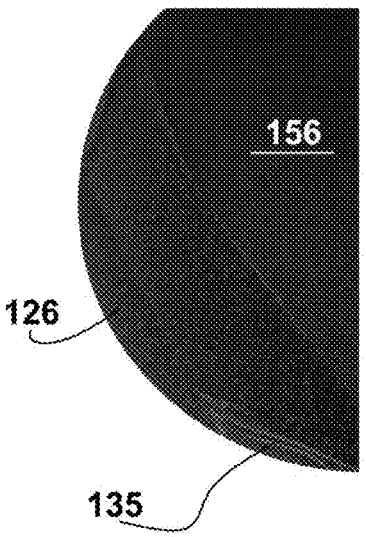
FIG. 20 is an internal view of the embodiment of FIG. 1, showing an embodiment of the hammock dam loop fastener attachment and location, and the peel loop fastener attachment and location, and the protective rim along the aperture.
Figure 21:
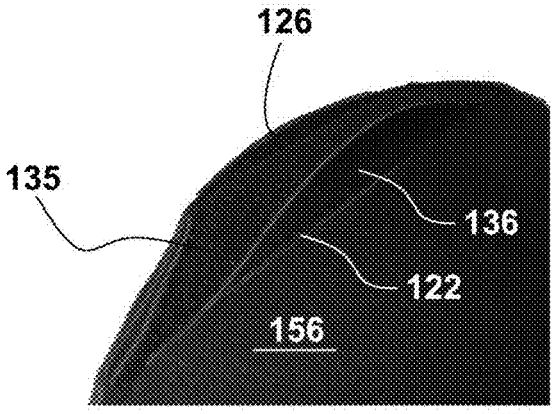
FIG. 21 is an internal view of the embodiment of FIG. 1, showing an embodiment of the sewn Hammock Dam Loop fastener attachment and location with a perspective showing both the fabric side and the loop side, and the Peel Loop fastener attachment and location, and the protective rim along the aperture.

The devices and methodologies disclosed herein may be further understood with respect to FIGS. 1-10, which illustrate a first particular, non-limiting embodiment of a weighted article in accordance with the teachings herein. With reference to FIG. 1, a weighted article 600 is provided which, in this particular embodiment, is generally ellipsoidal in shape. As seen in FIG. 10, the weighted article 600 consists of first 101 and second 102 portions of material which enclose an interior volume 100 and which, together, form a body 500. The first 101 and second 102 portions of material are adjoined along the peripheries thereof by a seam enclosed in a first protective rim 103 (see FIGS. 2 and 7-9). A sealable aperture 110 is provided in a portion of the seam by which a fill material 140 may be introduced into the interior volume 100. The aperture 110 is equipped with a second protective rim 106 (see FIGS. 2 and 7-9) which extends about the periphery thereof.

The first 103 and second 106 protective rims assist in keeping the edges of the first 101 and second 102 portions of material safe from abrasion, tearing, cutting and other damage, while also protecting the thread 105 around the rims and providing a secondary barrier to prevent the escape of fill 140. The first 103 and second 106 protective rims are not necessary to the function of the product, but are helpful in adding strength. In some embodiments, the first 103 and second 106 protective rims may also be utilized to provide grip texture and to implement color coding schemes (e.g., to indicate the total weight of the weighted article when it is filled). In the particular embodiment depicted, the weighted article 600 is equipped with an optional bar tac 104 to provide additional strength and support to the first 103 and second 106 protective rims and to the edge of the weighted article 600.

Figure 7:
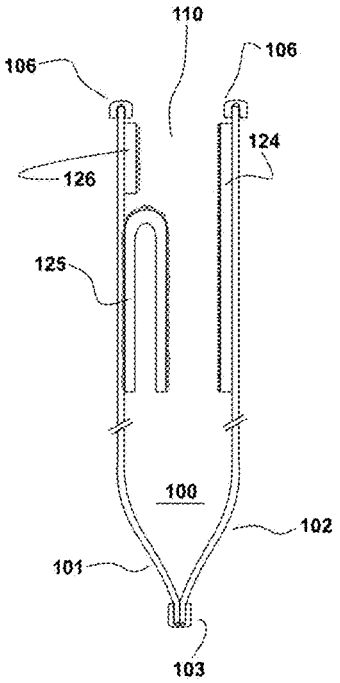
FIG. 7 is a cross-sectional view of the embodiment of FIG. 1, which shows details of the open aperture, Peel Loop location, Hammock Dam Loop location, and Hook Location.

FIGS. 7-9 illustrate the manner in which the weighted article 600 may be filled with a filler material 140 and sealed. FIG. 7 shows the weighted article in a first state, FIG. 9 shows the article in a second state, and FIG. 8 shows the article in a state which is intermediate between the aforementioned first and second states. As seen therein, a first portion of a first component 126 of a hook-and-loop fastener is disposed on the interior surface of the first portion 101 of the weighted article 600 adjacent to the aperture 110, and a second component 124 of a hook-and-loop fastener is disposed on the interior surface of the second portion 101 of the weighted article 600 adjacent to the aperture 110. In the particular embodiment depicted, the first component 126 is the loop portion, and the second component 124 is the hook component, although one skilled in the art will appreciate that these could be reversed to similar effect.

A dam 125, which is preferably a hammock dam and which preferably comprises a second portion of the first component of a hook-and-loop fastener, is disposed on the interior surface of the first portion 101 of the weighted article 600 adjacent to the first portion of the first component 126. The dam 125 preferably comprises a stretch loop material which is laminated to an elastomeric material such as neoprene. In the particular embodiment depicted, the dam 125 is generally U-shaped in a cross-section taken in the plane of the figures (that is, along a longitudinal axis extending from the aperture 110 to the interior volume 100 and perpendicular to the seam of the weighted article 600).

As seen in FIG. 7, when the weighted article 600 is in the first state, the first 126 and second 124 components of the hook-and-loop fastener are spaced apart from each other such that said interior volume 100 is in open communication with the environment external to the article by way of a channel which extends between the first 126 and second 124 components of the hook-and-loop fastener and which terminates at the aperture 110. This allows the interior volume 100 to be filled with a suitable filler 140 or, as the case may be, allows filler 140 to be removed from the interior volume 100.

As seen in FIG. 8, when the weighted article 600 is in the intermediate state, the dam 125 is brought into contact with the second 124 component of the hook-and-loop fastener, thus sealing the interior volume 100 off from the exterior environment. This also has the effect of partially closing the aperture 110 (see FIG. 7), as indicated by semi-closed aperture 111.

As seen in FIG. 9, when the weighted article 600 is in the second state, the first portion of the first component 126 of the hook-and-loop fastener is also brought into contact with the second 124 component of the hook-and-loop fastener, thus sealing the aperture 110 (see FIG. 7) off as indicated by fully closed aperture 112. The contact between the first portion of the first component 126 of the hook-and-loop fastener and the second 124 component of the hook-and-loop fastener helps to fully seal the body 500 and keep fill materials 140 inside said body 600, and also acts as a barrier 130, via peel strength, to accidental opening of the article from an external operator.

As noted above, the body 600 is preferably filled with a fill material 140 while the aperture 110 is completely open. Suitable fill materials may include, for example, sand, gravel, steel shot, pellets, rice, corn, grain, liquids (such as, for example, water), or the like. Because the aperture 110 (see FIG. 7) is very wide when the weighted article 600 is in the first state, it is not necessary to use a funnel during the fill process. Embodiments of the weighted article 600 may be made in accordance with the teachings herein with apertures 110 of 4 inches in diameter or larger, thus allowing the fill material 140 to be poured into the interior volume 100 of the weighted article 600 with a cup, bucket or shovel. As a result, the filling process for the devices disclosed herein may be several times faster than current filling methods used with prior art devices which incorporate tube or mechanisms that are on the order of 1 inch in diameter. For similar reasons, emptying the fill material 140 from the interior volume 100 may also be several times faster than emptying methods utilized with the aforementioned prior art devices.

Figures 3, 4:
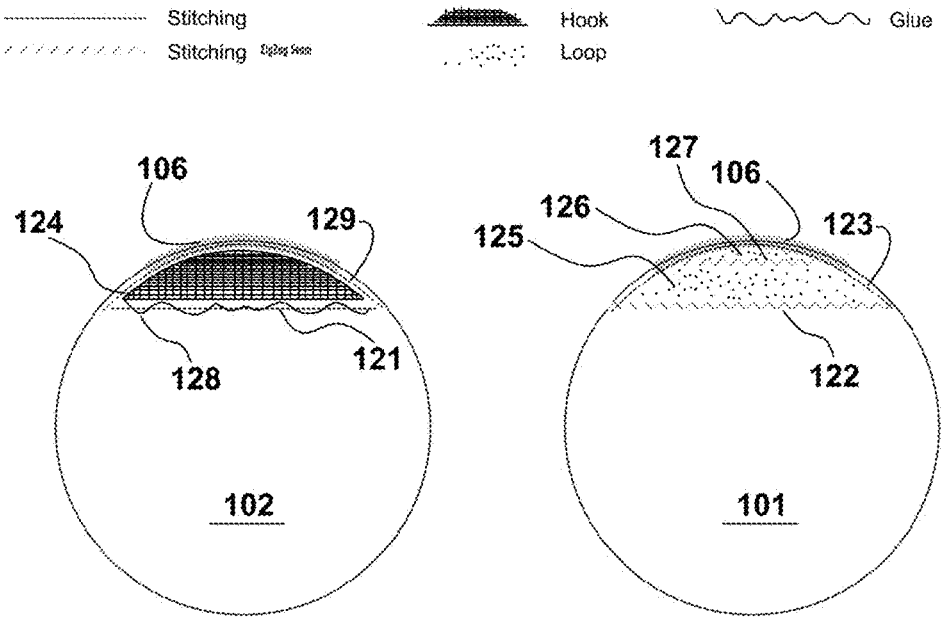
FIG. 3 is an internal view of the embodiment of FIG. 1, showing an embodiment of the hook fastener attachment and location, and the protective rim along the aperture.
FIG. 4 is an internal view of the embodiment of FIG. 1, showing an embodiment of the Hammock Dam Loop fastener attachment and location, and the Peel Loop fastener attachment and location, and the protective rim along the aperture.
Figure 5:
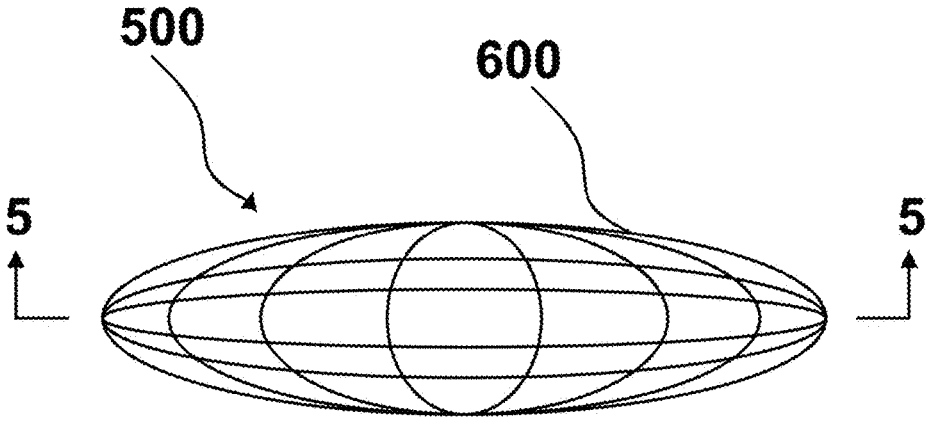
FIG. 5 is a cross-sectional view of the embodiment of FIG. 1 taken along LINE 5-5.
Figure 6:
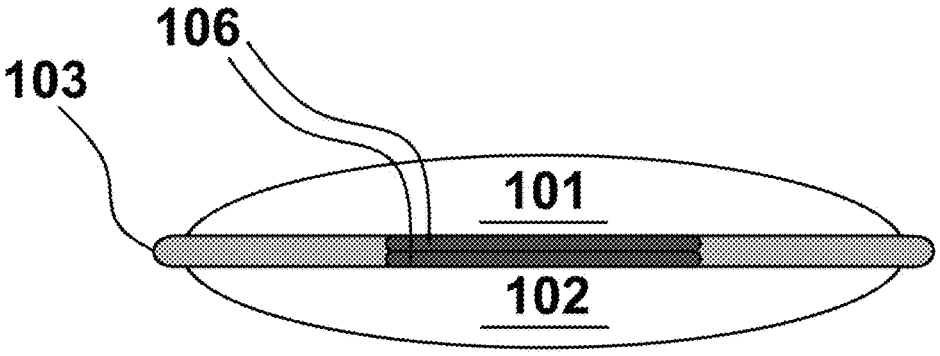
FIG. 6 is a side view of the embodiment of FIG. 1.

As seen in FIG. 3, suitable stitching 121 is preferably utilized to secure the second component 124 of the hook-and-loop fastener to the second portion 102 of the weighted article 600. In order to seal holes made from the stitching 121, a layer of glue 128 may be spread upon the area above and below the stitching 121. Indeed, such glue 128 may be utilized in any areas where the stitching 121 may cut or abrade the material that makes up the body 500 of the weighted article 600.

As seen in FIG. 4, after the stitching 121 and glue 128 are applied, zig-zag stitching 122 is applied to connect the second component 126 (which, in this particular embodiment, is the loop material) of the hook-and-loop fastener to the first portion 101 of the weighted article 600. Edge stitching 123 is also applied to connect the second component 126 of the hook-and-loop fastener to the first portion 101 of the weighted article 600 along the periphery of the weighted article 600. Zig-zag stitching 122 is also sewn over the elastic loop material of the dam 125, where it assists in connecting the (preferably neoprene) material of the dam 125 to the first portion 101 of the weighted article 600. Zig-zag stitching 122 is preferred in this application due to its ability to stretch with the material it is binding and to concurrently prevent the thread from ripping the fabric of the dam 125 and the first portion 101 of the weighted article 600.

In a preferred embodiment, the side that faces outward from the body 500 of the weighted device 600 is laminated with an abrasion resistant fabric 160. The abrasion resistant fabric 160 increases the mechanical integrity of the weighted article 600, improves its resistance to damage, and requires fewer stitches than, for example, the thin nylon fabric utilized in some prior art devices of this general type.

Without wishing to be bound by theory, it is believed that the internal movement of the fill material 140 toward the escape path 141 (see FIG. 9) puts pressure on dam 125, which may increase the shear bond at the interface 131 between the dam 125 and the second component 124 of the hook-and-loop fastener. In particular, the shear bond at the interface 131 may get stronger as more pressure is applied, since the pressure presses the dam 125 against the second component 124 of the hook-and-loop fastener. The fabric portion of the dam 125 creates a strong barrier against the fill material 140. Indeed, in the absence of this fabric portion, it is possible that the (preferably neoprene) base material would be slowly eroded by the abrasion of the fill material 140.

FIGS. 11-18 depict a second embodiment of a weighted article 601 in accordance with the teachings herein. This embodiment is similar in most respects to the embodiment of FIGS. 1-10, and hence, like reference numbers are utilized to indicate like features of the two embodiments. However, the weighted article 601 depicted in FIGS. 11-18 is generally pillow-shaped.

FIGS. 4 and 13-16 illustrate the details of a preferred embodiment of the stitching scheme which may be utilized in the weighted articles 101 disclosed herein. As seen therein, in the particular embodiment of the stitching depicted, the opposing first 101 and second 102 portions of the weighted article are preferably double-stitched together along a seam 117. Preferably, the seam 117 is constructed so that it faces outward from the device, since this is found to improve the impact resistance of the device and minimizes the likelihood that the fabric will tear along the seam 117.

Figure 22:
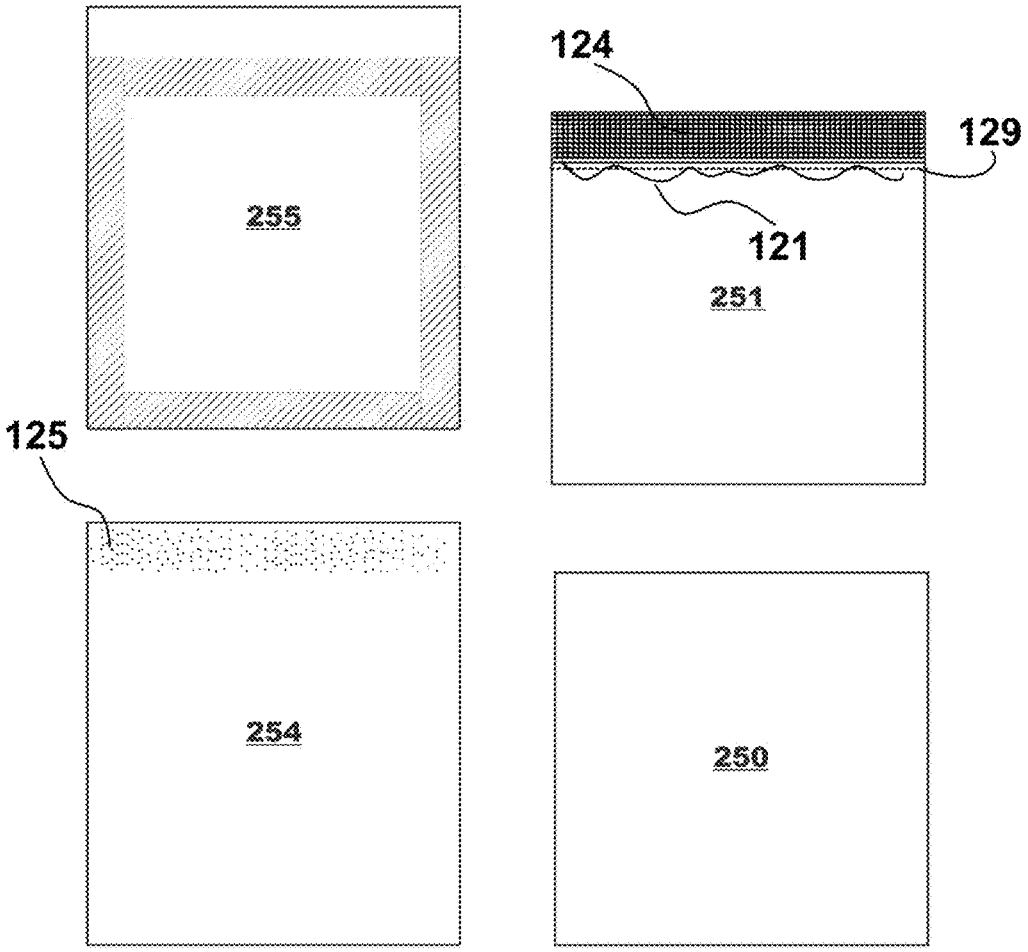
FIG. 22 is an illustration depicting a particular, non-limiting manner of incorporating structural edge webbing into an article made in accordance with the teachings herein to add strength along the edges of the article.
Figure 23:
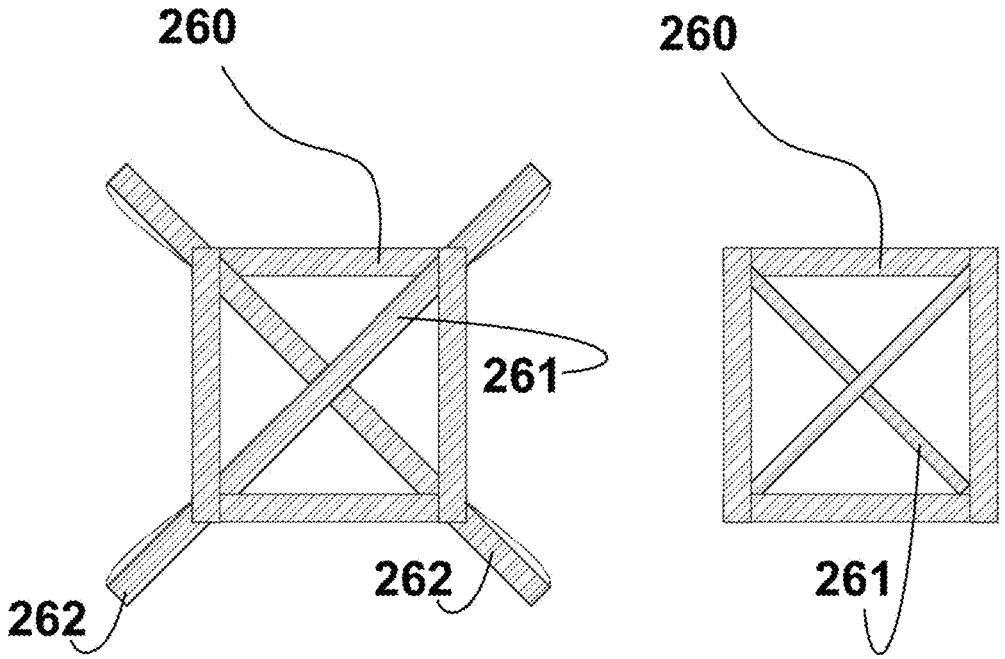
FIG. 23 is an illustration depicting a particular, non-limiting manner of incorporating diagonal structural edge webbing into an article made in accordance with the teachings herein to add strength along the edges of the article, and further illustrating how webbing extensions may be utilized as a handle or for accessories.

FIGS. 22-23 illustrate the manner in which structural edge webbing 260 and the diagonal structural webbing 261 may be integrated into the articles described herein to adding strength along the edges and diagonally across the article, respectively. Also show is the webbing extensions 262 that can be formed at the end of the edge webbing 260 or structural webbing 261. The webbing extensions 262 may be used as a handle or for accessories. It will be appreciated that the webbing extensions 262 are especially desirable in that the force applied to the webbing extensions 262 is spread over a large area, thus reducing or eliminating tearing or delamination at the points of attachment between the webbing extensions 262 and the rest of the weighted article 600.

Figure 24:
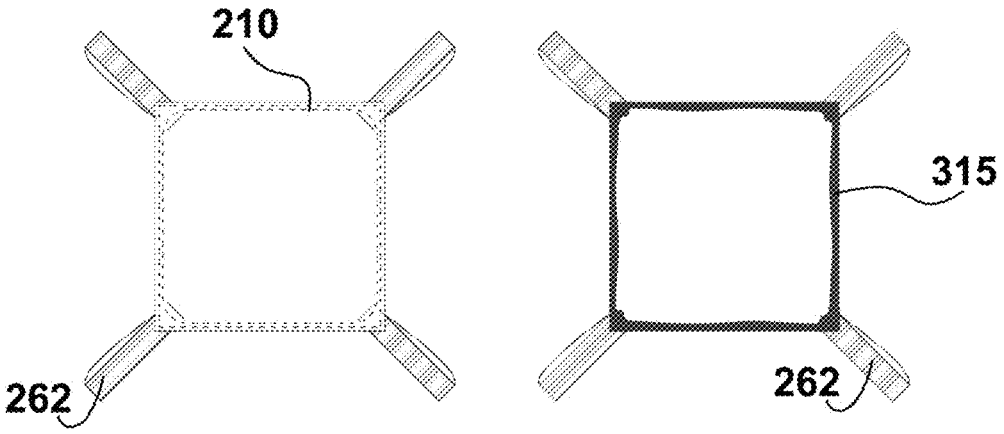
FIG. 24 illustrates a particular, non-limiting manner of implementing lock stitching around the edge of an article.

FIG. 24 illustrates a preferred embodiment of the lock stitch 210 that extends around the periphery of the article, effectively sandwiching the structural edge webbing 260 (see FIG. 23) between the first 101 and second 102 portions of the article. A protective exterior coating is applied over the lock stitch 210 and along the rim seals of the lock stitch 210, providing strength, abrasion resistance and impact resistance thereto.

Figure 25:
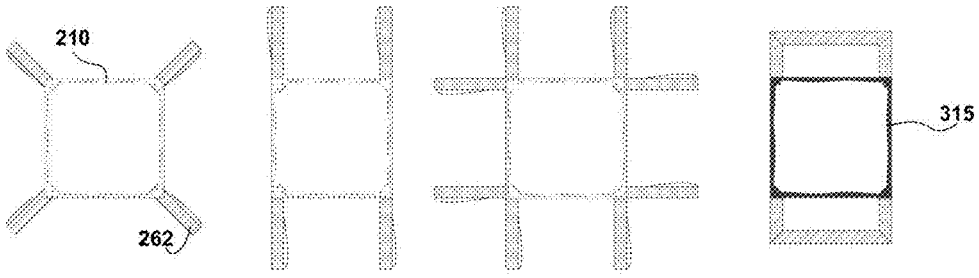
FIG. 25 illustrates several particular, non-limiting embodiments of webbing extensions in accordance with the teachings herein.

FIG. 25 illustrates some particular, non-limiting embodiments of the webbing extensions 262 possible with articles produced in accordance with the teachings herein. As seen therein, numerous possibilities exist with respect to the number of these extensions and their orientations and shapes. Thus, for example, these extensions may extend along an axis that is parallel to one or more sides of the article, or may extend diagonally from a corner of the article. Moreover, while one preferred embodiment of these extensions takes the form of a series of loops that can be readily grasped by the user, in other embodiments, the attachments may take the form of one or more handles that may extend out from the article, and may contain one or more segments that are parallel to a side of the article.

Figure 26:
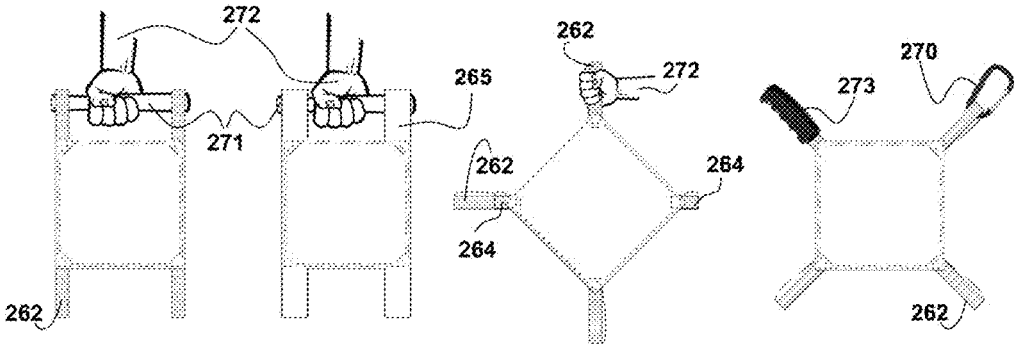
FIG. 26 illustrates several particular, non-limiting methods for using the articles of FIG. 25.

FIG. 26 illustrates further variations that are possible with respect to the webbing extensions 262. Thus, as seen therein, the webbing extensions 262 may include one or more handles 263, may be implemented as small webbing loops 264, or may include one or more handles 265 made from the material used to form the bulk of the article. The webbing extensions 262 may also be implemented with carabineers 270, dowel rods 271 (shown with gripping hand 272), or plastic/rubber handles 273. The use of webbing loops 263 as handles for bare hands (see gripping hand 272) is also contemplated.

Figure 27:
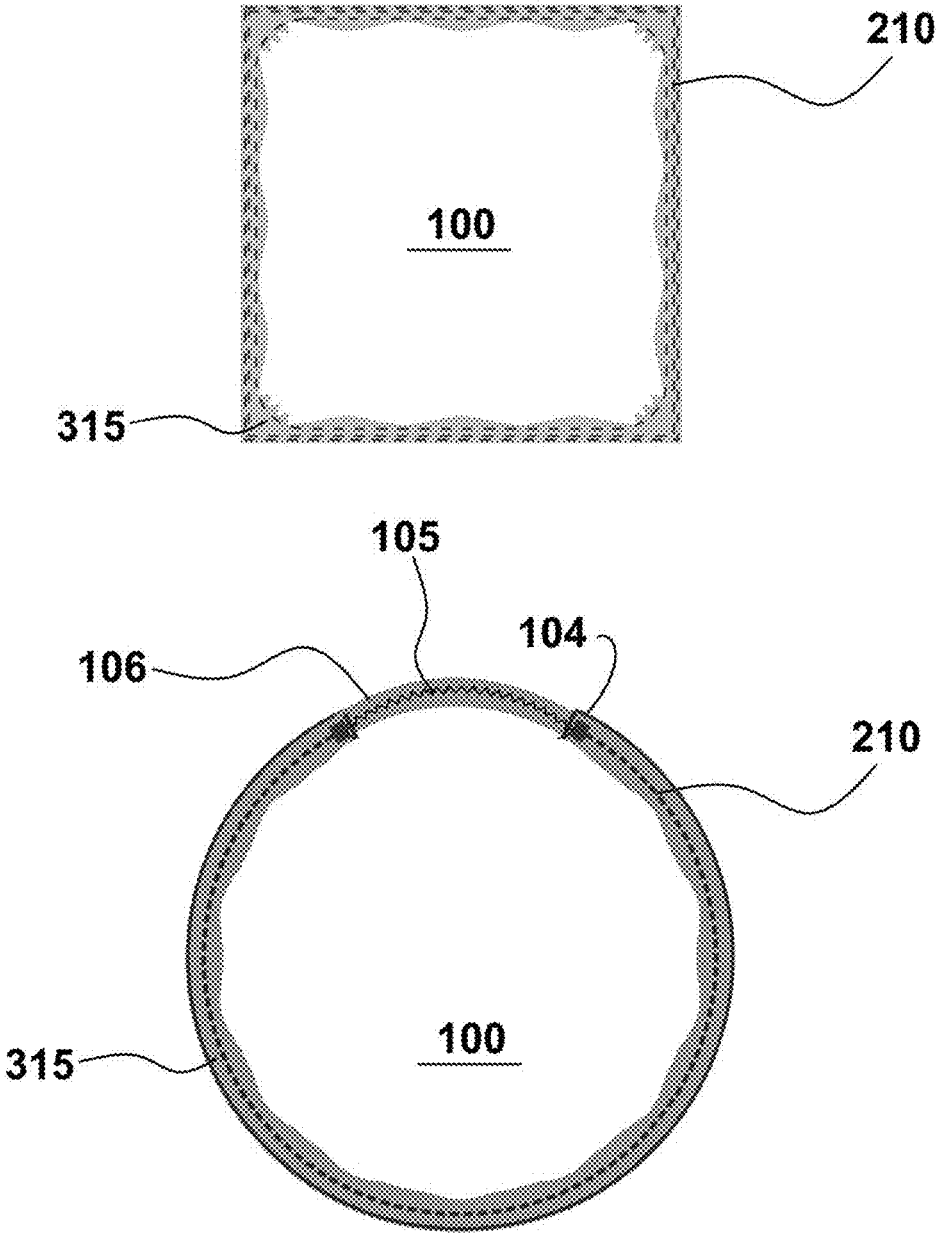
FIG. 27 illustrates embodiments of round and rectangular versions of articles in accordance with the teachings herein which have been provided with a protective exterior coating along the rim and which extends over the sides of the article.

FIG. 27 illustrates particular, non-limiting embodiments of articles in accordance with the teachings herein which have round (ellipsoidal) and rectangular (parallel-piped) profiles. The embodiments depicted feature a protective interior coating 310 along the rim of the article. This coating 310, which preferably surrounds and coats the lock stitch 210, also binds the first portion 101 of the article to the second portion 102 of the article.

Figure 28:
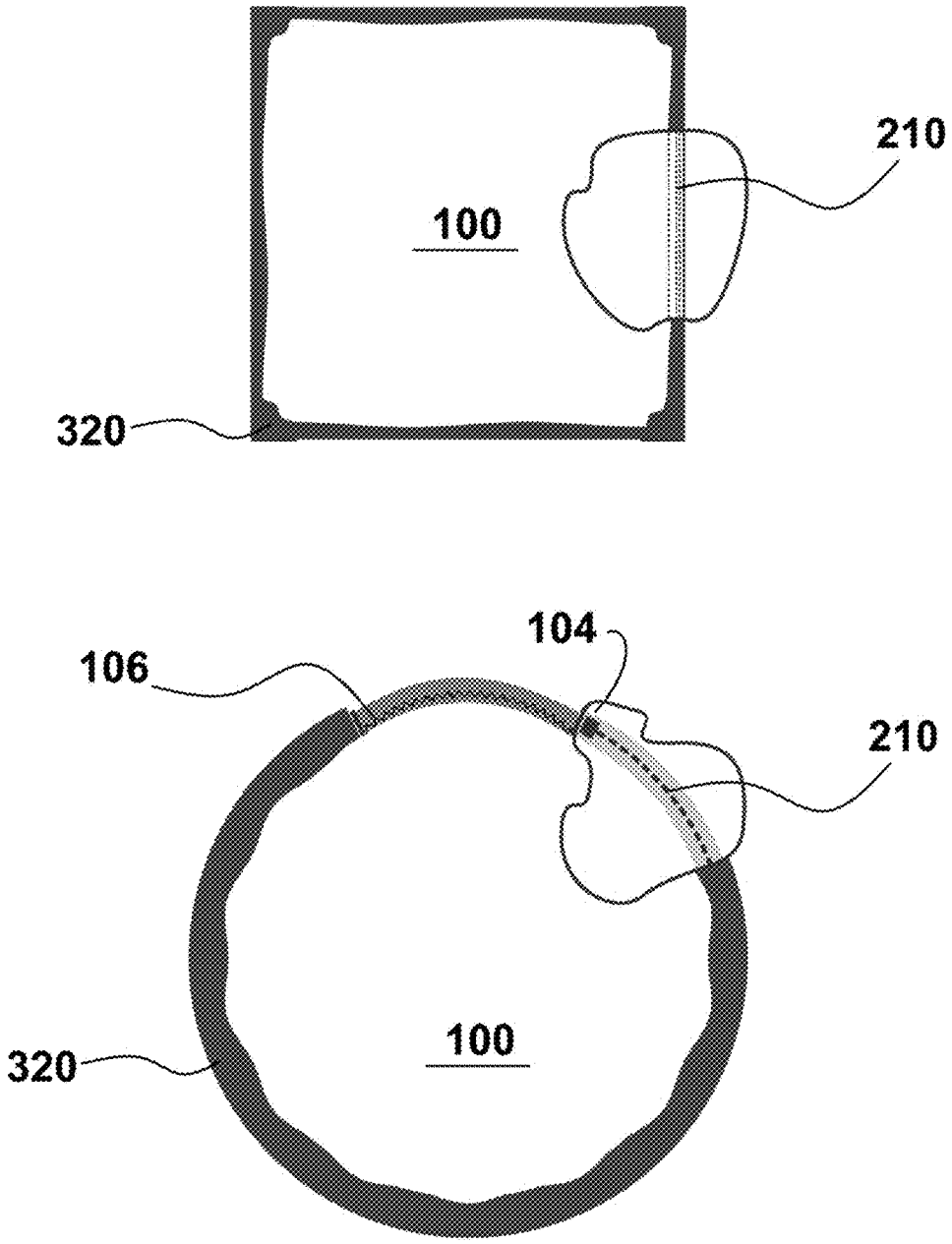
FIG. 28 illustrates embodiments of round and rectangular versions of articles in accordance with the teachings herein which have been provided with a protective exterior coating along the entire inside of the article, and which surrounds and coats the lock stitch.

FIG. 28 illustrates particular, non-limiting embodiments of articles in accordance with the teachings herein which have round (ellipsoidal) and rectangular (parallel-piped) profiles. The embodiments depicted feature a protective exterior coating 320 along the rim of the article. This coating preferably surrounds, covers and coats the lock stitch 210 (for illustration purposes, a portion of the protective exterior coating 320 has been removed to reveal the underlying lock stitch 210) and extends over the outsides of the article from the first portion 101 to the 102 second portion thereof.

Figure 29:
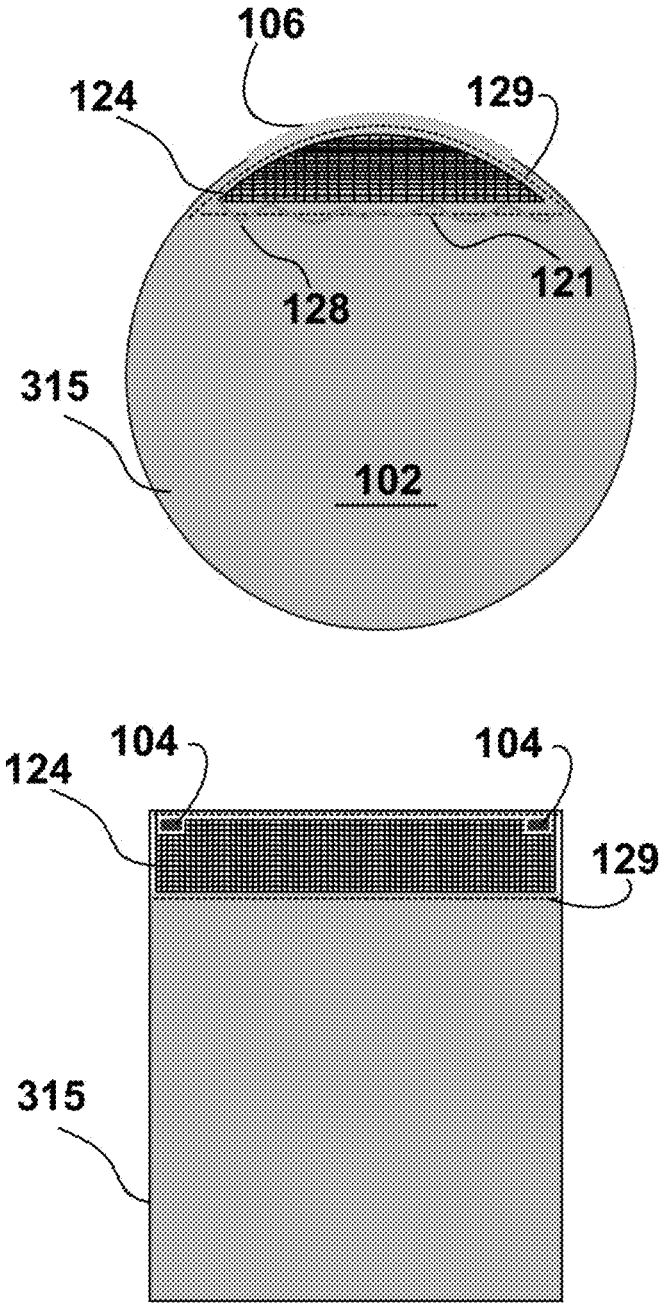
FIG. 29 illustrates embodiments of round and rectangular versions of articles in accordance with the teachings herein which have been provided with a protective interior coating along the entire inside of the article, and which surrounds and coats the lock stitch.

FIG. 29 illustrates particular, non-limiting embodiments of articles in accordance with the teachings herein which have round (ellipsoidal) and rectangular (parallel-piped) profiles. The embodiments depicted feature a protective interior coating 315 along the entire inside of the article, which surrounds and coats the lock stitching 210 and binds the first portion 101 to the second portion 102. An interior coating 315 of this type may provide strength, abrasion resistance and impact resistance to the article, and may also allow for weaker materials and fabrics (which are generally less expensive) to be used in its construction.

Figure 30:
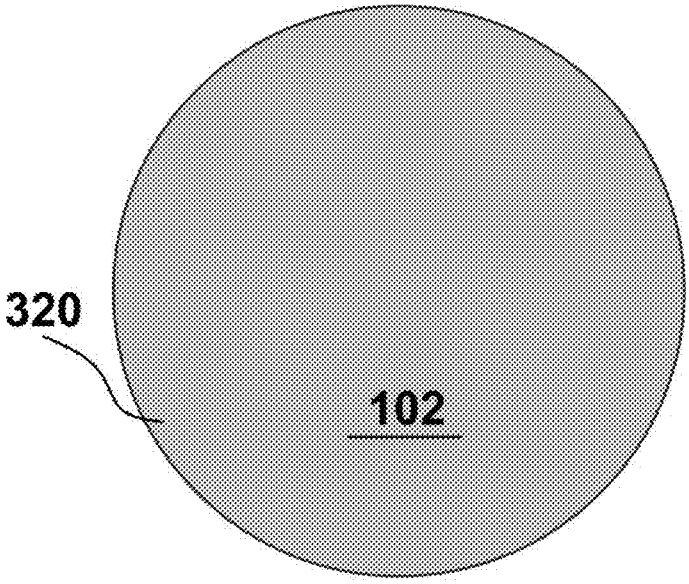
FIG. 30 illustrates embodiments of round and rectangular versions of articles in accordance with the teachings herein which have a protective exterior coating across the exterior of the article.
Figure 30:
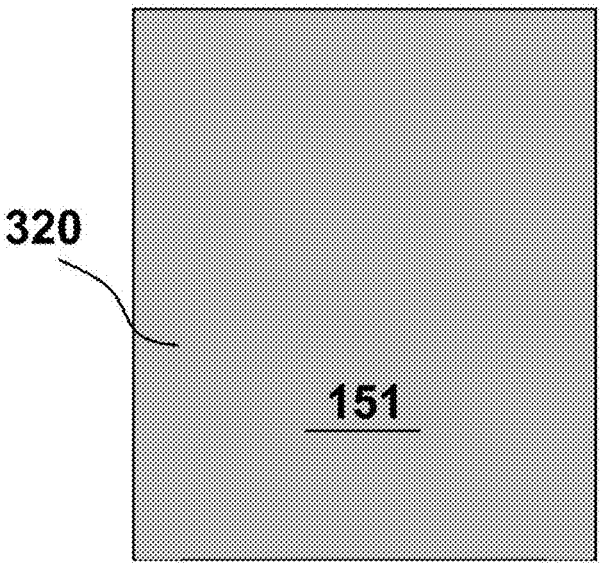

FIG. 30 illustrates particular, non-limiting embodiments of articles in accordance with the teachings herein which have round (ellipsoidal) and rectangular (parallel-piped) profiles. The embodiments depicted feature a protective exterior coating 325 along the entire inside of the article, which surrounds and coats the lock stitching 210 and binds the first portion 101 to the second portion 102. Such a coating may impart strength, abrasion resistance and impact resistance to the article, while also allowing for weaker materials and fabrics (which are generally less expensive) to be used in its construction.

Figure 31:
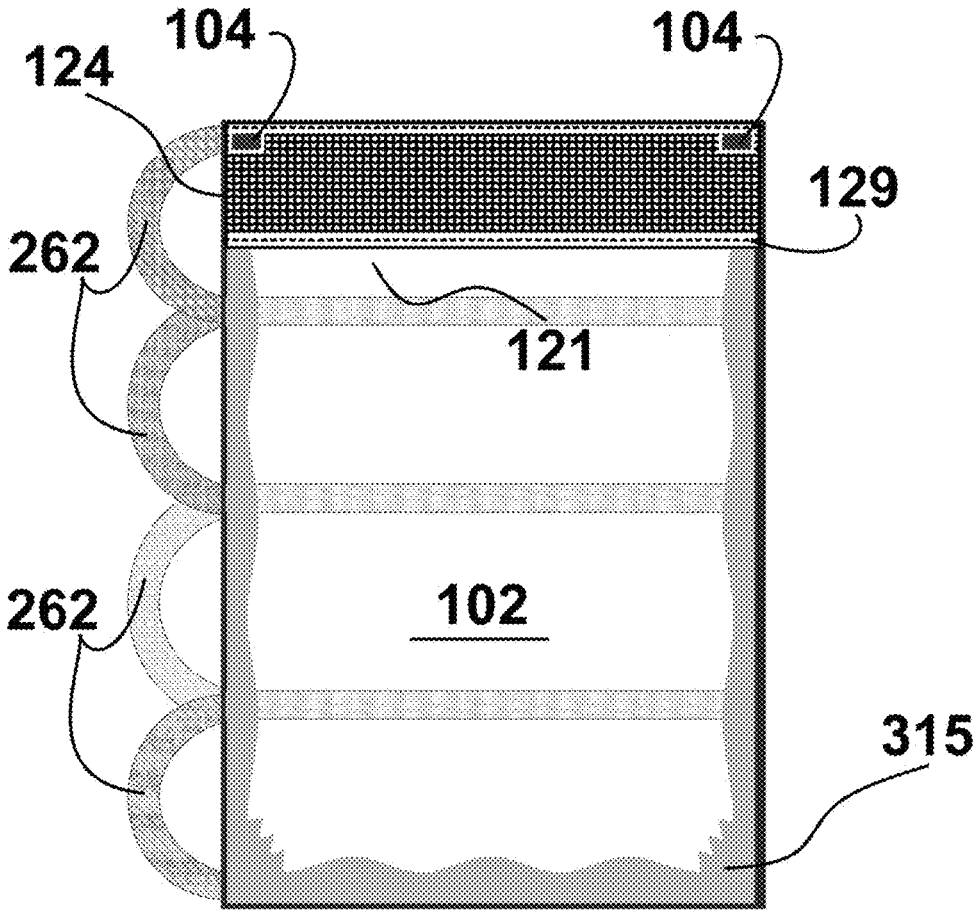
FIG. 31 illustrates a rectangular embodiment of an article in accordance with the teachings herein which is equipped with a protective exterior coating along the rim thereof.

FIG. 31 illustrates a particular, non-limiting embodiment of a rectangular (parallel-piped) article in accordance with the teachings herein. The article depicted therein features a protective exterior coating 315 along the rim thereof, which surrounds and coats the lock stitching 210 and binds the first portion 101 to the second portion 102. The particular embodiment depicted is equipped with a plurality of webbing loops 262 which may be used for specific exercises such as, for example, Olympic lifts. The structural edge webbing 260 in this embodiment also goes through the body of the article in 3 locations (in addition to the edges), thereby adding strength to the article. The article may be constructed in such a way as to allow a user to fill the bag with, for example, the contents of a 50 lb. bag of sand by quickly and easily dumping the entire bag of sand into the bag. This feature thus allows the article to be immediately available for use.

FIGS. 32-35 illustrate a particular, non-limiting embodiment of a round (spherical) weighted article in accordance with the teaching herein. The article in this embodiment is equipped with a protective interior coating 310 along the rim thereof, which surrounds and coats the lock stitching 210 and binds the first portion 101 to the second portion 102.

Figure 32:
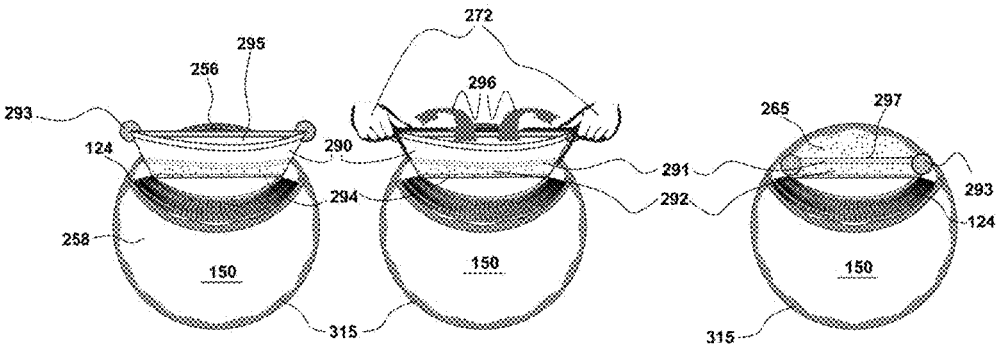
FIG. 32 illustrates an embodiment of a round version of a weighted article in accordance with the teachings herein, and a method for filling the same.
Figure 33:
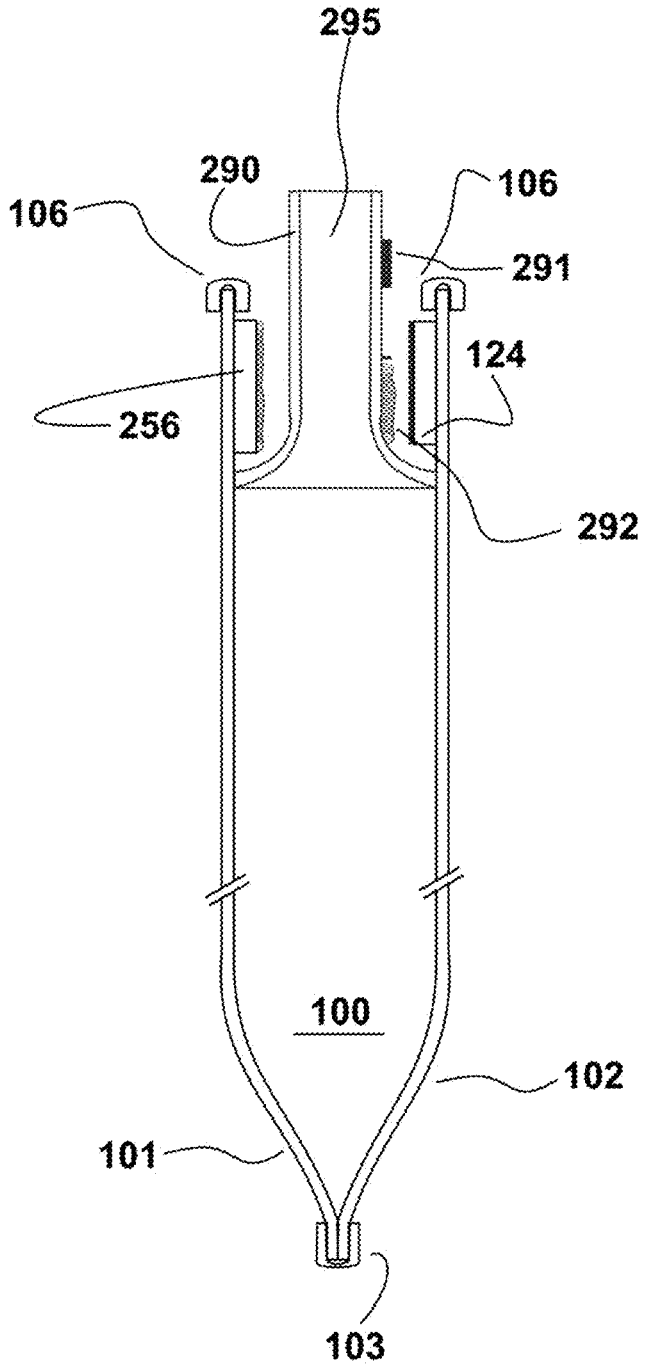
FIGS. 33-35 are cross-sectional illustrations depicting a round version of a weighted article in accordance with the teachings herein, and a method for filling the same.
Figure 34:
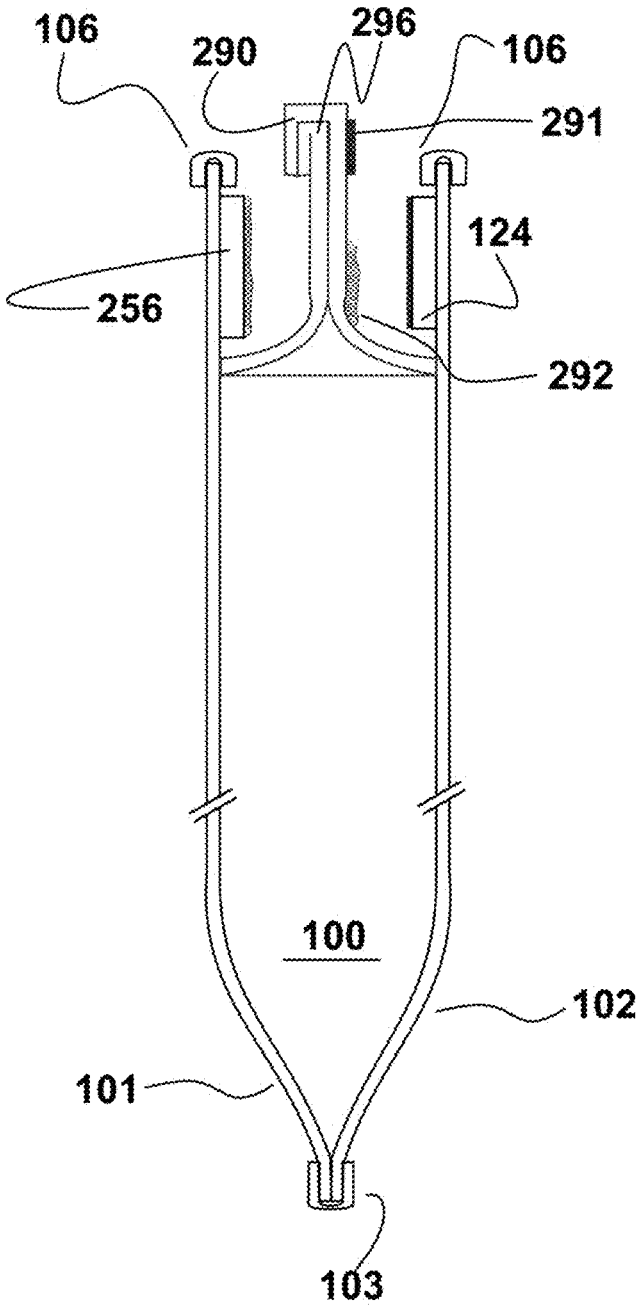
Figure 35:
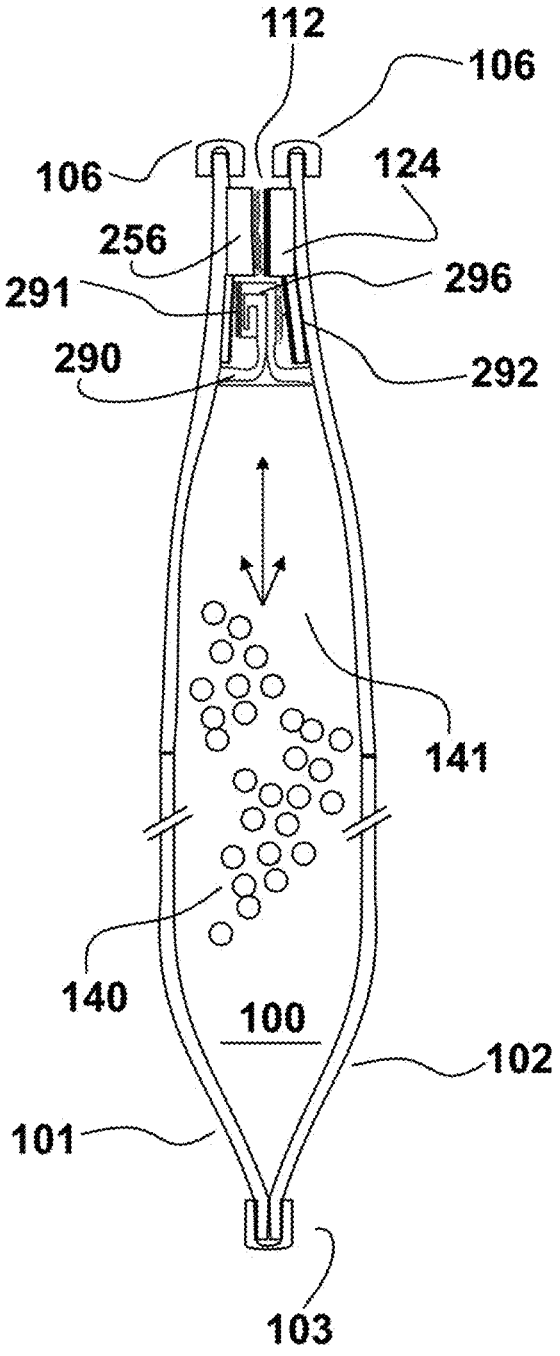

FIGS. 32-33 illustrate the envelope 290 feature, and the related methodology which may be utilized for sealing articles of this type. As seen in FIG. 33, the article depicted therein is equipped with an envelope 290 which is connected via an envelope connection seam 294 (see FIG. 32) to the body of the article. In its extended configuration, the envelope 290 provides a conduit which is in open communication with the interior volume 100 of the article, and which is in open communication to the exterior environment by way of a mouth 295. This envelope 290 may thus be used to fill or empty the interior volume 100.

The article may be filled by pouring a suitable fill 140 into the mouth 295 of the envelope 290. After a suitable amount of filler has been added, the user 296 rolls the envelope 290 up via multiple rotations (as indicated by arrows 296), effectively closing it like a dry bag. The envelope 290 is then held in place by end tabs 293, which prevent the envelope fabric from unraveling. The end tabs 293 preferably utilize a hook-and-loop type fastener to hold the envelope fabric in place.

Normally, dry bag closures use clips which latch to one another (one from each end of the topmost seam), making a round shape. Such a round shape restricts the closure of the mouth 295. Therefore, a flat roll may be utilized in conjunction with end tabs 293 to prevent the envelope 290 from creating a bulge inside the article. Once the envelope 290 is fully rolled, the hook 291 and loop 292 components hook to the corresponding hook feature 124 (which is preferably made of nylon) and the corresponding loop material 265 allows the article to be free from hard plastic clips which, when used in sandbags and dry bags, either cause damage to the bag, come unclasped or are uncomfortable when using the bag for exercise.

The tabs 293 at the end tips of the envelope 290 preferably contain hook features on one side of the tab, and loop features on the opposing side. Once the envelope 290 has been twisted down, both the hook 291 and loop 292 features on the loop material, as well as, the corresponding hook features 124 and the corresponding loop features 265, engage to seal the mouth 295 of the envelope 290.

Figure 36:
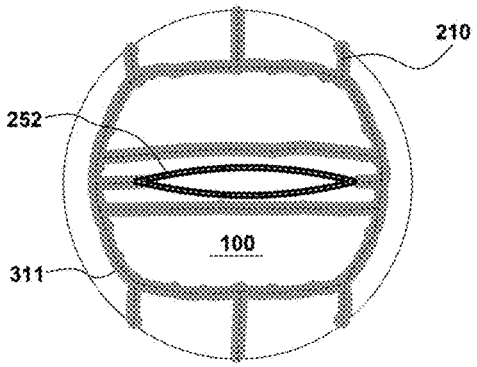
FIG. 36 illustrates a particular, non-limiting embodiment of a spherical version of a weighted article (a medicine ball) having a protective interior coating along the rim which surrounds and coats the lock stitching and binds the panels to one another to create the sphere.

FIG. 36 illustrates another particular, non-limiting embodiment of a weighted article in accordance with the teachings herein. This embodiment, which may be utilized as a medicine ball, features a spherical version of the weighted article and is equipped with a protective interior coating 311 along the rim thereof. This coating 311 surrounds and coats the lock stitching 210 and binds the panels 107 to one another to create the sphere. The particular embodiment depicted further includes a dam closure 252 with an open mouth. The dam closure 252 preferably comprises a releasable fastener which is preferably a hook-and-loop fastener (such as, for example, those sold under the tradename VELCRO™).

Figure 37:
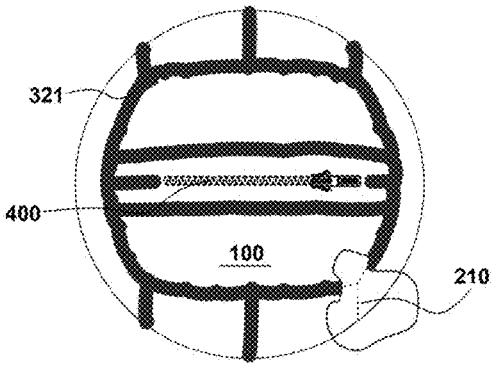
FIG. 37 illustrates a particular, non-limiting embodiment of a spherical version of a weighted article (a medicine ball) having a protective exterior coating along the rim which surrounds and coats the lock stitching and binds the panels to one another to create the sphere.

FIG. 37 illustrates another particular, non-limiting embodiment of a weighted article in accordance with the teachings herein. This embodiment, which may also be utilized as a medicine ball, features a spherical version of the weighted article and is equipped with a protective exterior coating 311 along the rim thereof. This coating 311 surrounds and coats the lock stitching 210 and binds the panels 107 to one another to create the sphere. The particular embodiment depicted further includes a zipper closure 400.

Figure 38:
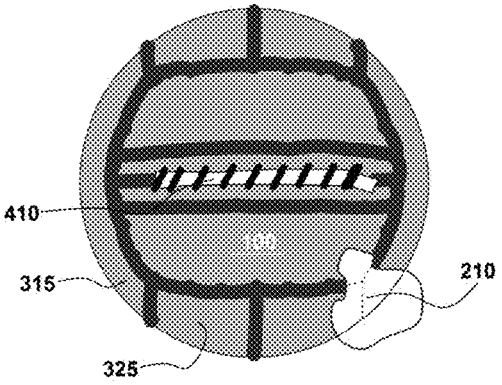
FIG. 38 illustrates a particular, non-limiting embodiment of a spherical version of a weighted article (a medicine ball) with either a protective interior coating along the full inside of the bag, or a protective exterior coating across the body of the bag, which surrounds and coats the lock stitching and binds the panels to ones another to make the sphere.
Figure 39:
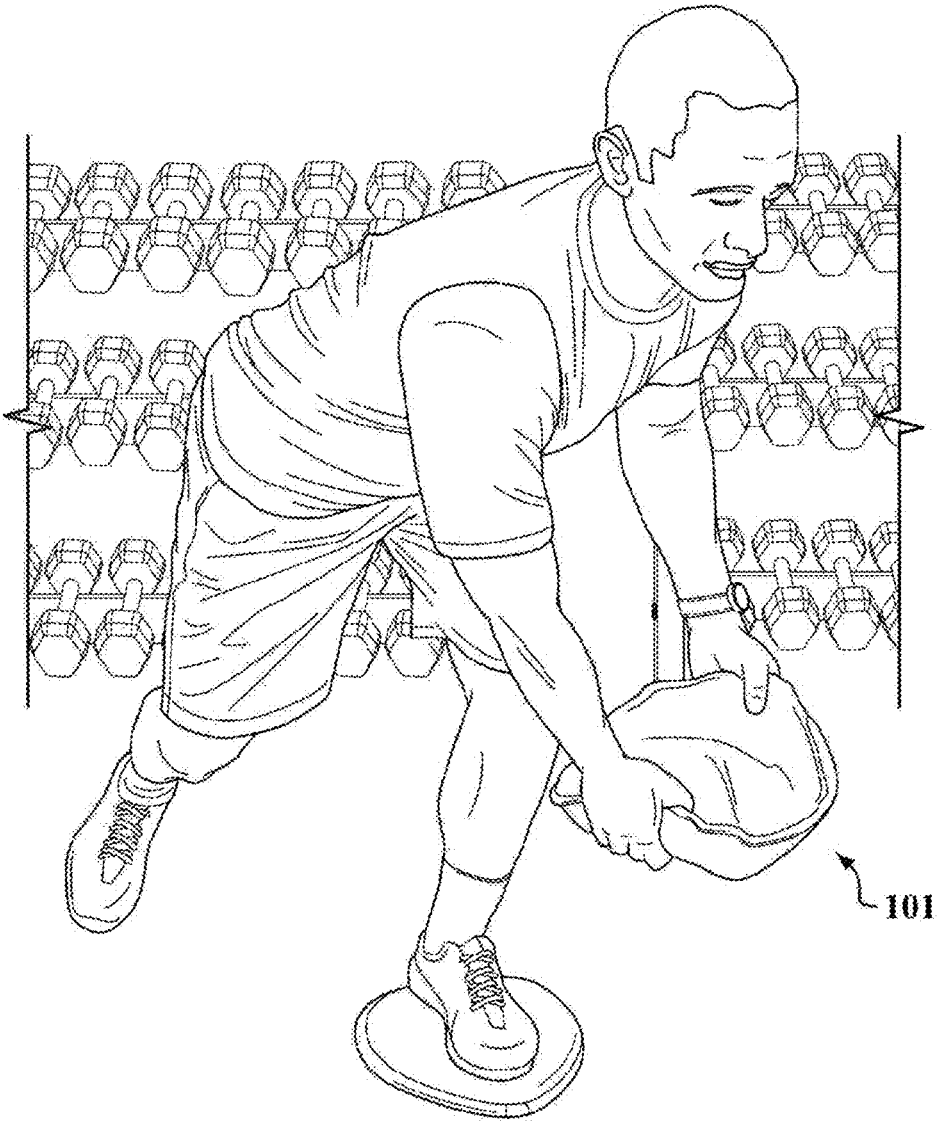
FIGS. 39-41 illustrate a prior art weighted article.
Figure 40:
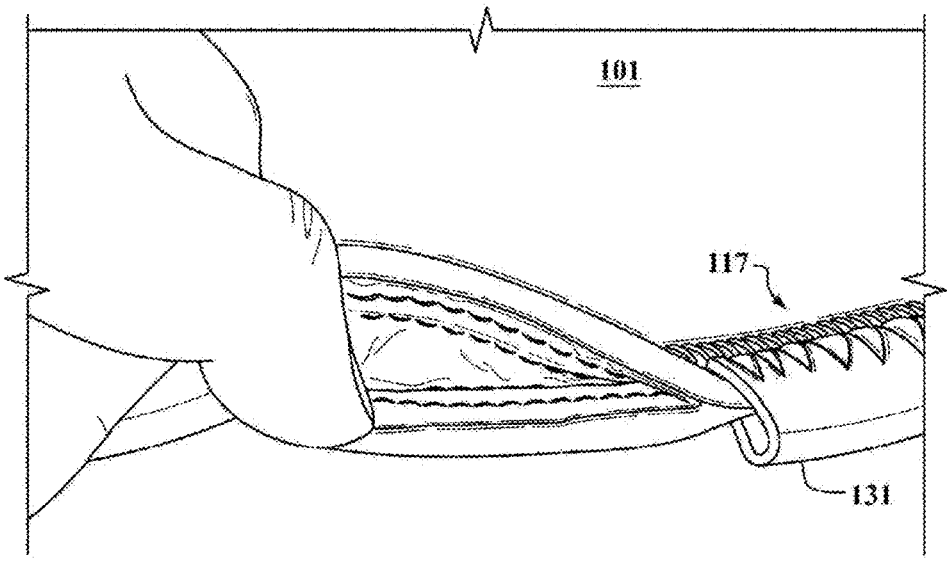
Figure 41:
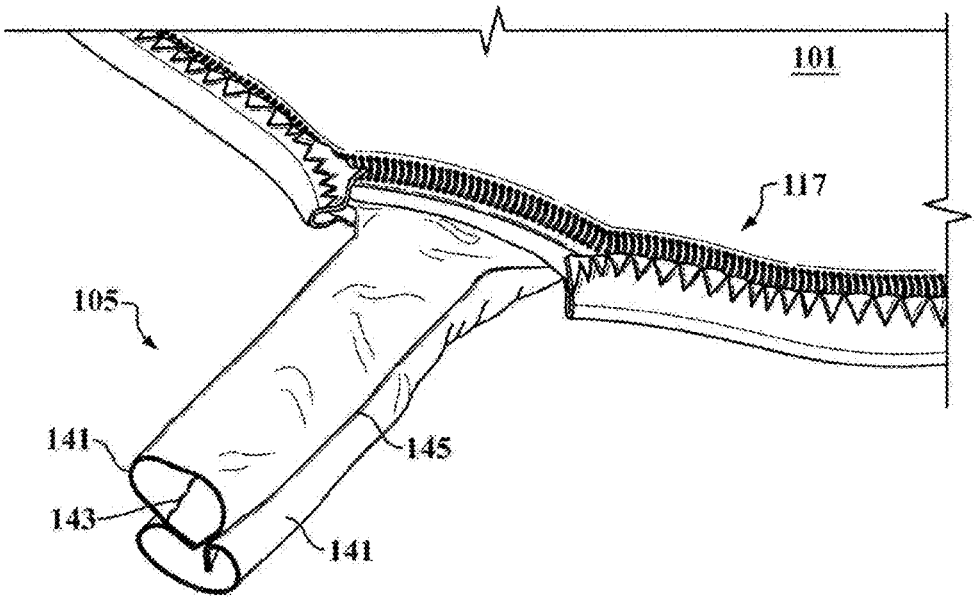

FIG. 38 illustrates another particular, non-limiting embodiment of a weighted article in accordance with the teachings herein. This embodiment, which may also be utilized as a medicine ball, features a spherical version of the weighted article and is equipped with either a protective interior coating 315 along the full inside of the article, or a protective exterior coating 325 across the body of the article. This coating 311 surrounds and coats the lock stitching 210 and binds the panels 107 to one another to create the sphere. It is found that full coatings of this type provide strength, abrasion resistance and impact resistance, and also allow for the use of weaker materials and fabrics (which are generally less expensive) to be used in the construction of the article. The particular embodiment depicted features a lacing closure 410.

The coatings described herein may be applied to various weighted articles, including sandbags, to increase the seam strength and the strength of the fabric body. As As noted above with respect to FIGS. 36-38, these coatings may be utilized on medicine balls, which may be made out of a suitable fabric such as nylon, polyester or vinyl. Examples of medicine balls to which these coatings may be applied may be found, for example, at www.dynamax.com. Medicine balls made with these coatings are found to be softer and easier to throw and catch.

Medicine balls commonly have an outer wall of fabric and are often filled with soft foam (and/or other fill), along with some form of weight at the center (this may take the form, for example, of sand, steel shot, rubber pellets, or the like). One common problem with medicine balls (especially those made from fabric) is that they have a tendency to bust open like conventional sandbags. Typically, such failure occurs at the seams or the material adjacent to the seams, since this material may tear under pressure and friction when the ball is being used. In fact, most medicine balls fail within 1-2 years of standard use.

The coating described herein may be applied to the seams of a medicine ball, and is strong enough and flexible enough to strengthen the seam region thereof. This has the effect of increasing the life of the balls via increased fabric durability, seam strength, and impact resistance.

The weighted articles disclosed herein, which may be configured as sandbags, have several advantages over conventional sandbags. In particular, conventional weighted sand bags are known to require a trade-off between being quick/easy to fill but hard to seal (such as, for example, those taking the form of a large bag with one end completely open until the user attempts to seal it), or slow/difficult to fill but easy to seal. Sandbags also tend to bust under pressure, along the seams, and especially at the closure location. If such sandbags are used for exercise, there is generally leakage of fill material, which presents issues for sandbag weight retention, cleanliness and safety. Moreover, some prior art sandbags use vinyl protective rims which crack over time. These cracks may cut users, look shoddy, and can pull threads and tear seams.

In a preferred embodiment, the weighted articles disclosed herein are equipped with protective rims which are designed to keep the seam coating inside the bag while coating is still in liquid state. Once the coating is dry, it provides a foundation for the seams and for any protective rim, whether it is sewn on or a dipped/painted/sprayed protective coating. The protective rims may be made of a suitable coating material (such as, for example, an epoxy, polyurethane, urethane, neoprene, rubber, urea or similar elastic or non-elastic chemical coating) which binds to fibers of the bag and strengthens the bag, rather than being stitched to bag like prior art rims. Exterior rims equipped with a protective coating are found to last longer and look better than the rims commonly found on prior art sandbags.

In some embodiments, the weighted articles described herein use the protective coating along all areas of the inside or outside (or both) of the fabric or material (without coating the releasable fasteners). This has the desirable effect of strengthening the body of the weighted article.

Some prior art sandbags use tubes or collapsible inlets whose design causes them to be forced from the inside of the body to the outside of the body under the pressure of the fill material. This process weakens the sandbag and puts it at risk of catastrophic failure when users grab the tube and use it as a handle.

By contrast, in a preferred embodiment of the weighted articles described herein, the weighted article is both quick and easy to fill, and has the added benefit of being easy to seal and unseal. In such embodiments, there are no parts that can be forced outside of the body of the device or be damaged by the user. The preferred closure itself has a double seal, preventing any fill materials from escaping and keeping external sources from accidentally opening the seals. In some embodiments, a closure having a single seal is utilized as the main seal which similarly and effectively keeps all fill materials sealed inside the body of the article.

The concepts implemented in the weighted articles described herein may also be applied to backpacks and other devices that require easy retrieval and need to keep items from coming dislodged when upside down. Traditional hook-and-loop closures are characterized by a tear strength (caused by peeling the hook and loop components apart from each other from a single pull point) or a static shear strength (where the two parts (hook and loop) are forced to move across each other before release). However, in a preferred embodiment, the weighted articles described herein use the novel approach of dynamic pressure combined with reverse shear strength. This combination is created when the components of the hook and loop fastener are forced to move across each other under pressure, with the pressure increasing the bonding power of the components. Hence, the closure construction utilized in the devices disclosed herein may be used in a wide variety of weight-bearing articles.

The preferred embodiment of the weighted articles described herein is more rugged and durable than similar articles found in the prior art, which frequently suffer from thin walled bodies or laminated fabrics that do not resist cuts or heavy abrasion. Preferably, the bodies of the weighted articles described herein are constructed from a stretchy, resilient or elastomeric material, and more preferably, from a neoprene/abrasion resistant fabric laminate. The use of an abrasion resistant fabric laminated to the outside wall of the body of the article also keeps threads from abrading the neoprene, thereby inhibiting leakage or rupture. The use of an abrasion resistant laminate over neoprene also assists in gripping the articles, which is helpful when they are being used as exercise devices.

If a traditional sandbag is made of an elastomer (like neoprene) and in a non-circular shape, when the bag is picked up, the weight of the contents (or fill) sag to one end, causing stress on the seams, particularly along the corners when carried and the sides when slammed or dropped.

The sandbag described herein, in one embodiment, uses nylon/polyester/polypropylene or elastic webbing to create an internal boning and strengthening structure. The webbing structure strengthens the outer edges of the sandbag, as well as, can create a diagonal structure which provides strength to the bag when holding it via one of the corners. The internal webbing structure also provides a buffer against the pressure of the internal fill, protecting seams, both if used alone or acting in conjunction with the Protective Interior or Exterior Coating.

In some embodiments, the weighted articles described herein utilize a protective interior and/or exterior coating which may comprise, for example, an epoxy, polyurethane, urethane, neoprene, rubber, rubber cement, polyurea or similar elastic or non-elastic chemical coating. Such coatings bind to fibers of the weighted article, thereby allowing the weighted article to be constructed of elastic or non-elastic fabrics or materials. Due to the strength of this coating, the base materials of the weighted article may be constructed from materials that might otherwise be inferior, weaker, or non-traditional materials (e.g., materials that are usually unable to withstand the abuse to which the weighted articles described herein are typically subjected). Such inferior materials are frequently less expensive and more readily available.

In some embodiments, the weighted articles described herein utilize a protective interior coating along the rim to act as a glue between the opposite sides of the material being stitched to together, as well as to provide strength in the seam (since the material around the seams will not pull back and forth across the stitches when treated with such a coating). The use of a coating along the rims also provides a buffer against the pressure of the internal fill, thereby protecting seams and the material of the weighted article.

In some embodiments, the weighted articles described herein utilize a protective interior coating along the seams of the releasable fasteners. Such a coating, which may comprise an epoxy, polyurethane, urethane, neoprene, rubber, rubber cement, polyurea or similar elastic or non-elastic chemical coating, binds to fibers of the weighted article, and strengthens the seam when it is under pressure from the fill material and the pushing and pulling of the fabric.

In some embodiments, the weighted articles described herein utilize a non-elastic fabric along with a protective interior and/or exterior coating. Here it is notable that non-elastic fabrics are not typically used in weighted articles of the type described herein, since ruptures in such materials are common along the seams when the article is dropped or slammed.

In some embodiments, the weighted articles described herein utilize sonic welds for the opposite sides of the material, instead of stitching. Such an approach may create a stronger bag with no traditional seam weaknesses.

In some embodiments, the weighted articles described herein utilize nylon/polyester/polypropylene or elastic webbing to create an internal boning and strengthening structure which extends past the boundaries of the article. The webbing that extends past the edges of the article may then be utilized as handles, or as loops for carabineers/dowels/hooks/attachments, or may be combined (temporarily or permanently) with other materials to create an attachment to the article. Such other materials may include, for example, releasable fasteners, plastic, rubber, wood, fabric or metal. The portion of the webbing that extends past the edges of the article may be used in particular locations as handles for particular exercise movements.

In some embodiments, the weighted articles described herein, an envelope closure is utilized in conjunction with a releasable fastener (such as, for example, a hook-and-loop type fastener). The envelope allows for the filling and emptying of fill material without interfering with the releasable fastener of the closure, which could get gummed up with some types of fill materials. In some embodiments, the envelope circumscribes, and is attached to, the fabric at the base of the releasable fastener near the opening of the weighted article. The envelope is preferably sewn to the inside of the article, around the base thereof.

Once the envelope is rolled down, the releasable fastener bonds to the envelope fabric to prevent it from unraveling. Normally, dry bag closures use clips which latch to one another (one from each end of the topmost seam), thus creating a round shape. However, such a round shape restricts the closure of the mouth of the article. Therefore, as described above, a flat roll is preferably utilized, along with a releasable fastener, to prevent the envelope from creating a bulge inside of the article.

Preferably, the bottom of envelope has a releasable fastener (and preferably, both components of a hook-and-loop fastener) at the base thereof which, when rolled correctly, causes it to bond to itself around the closure. The end tips of the envelop are preferably equipped with tabs that have the hook component of a hook-and-loop fastener on one side, and the loop component of a hook-and-loop fastener on the other side. Once the envelope has been twisted down, the releasable fastener binds to the outside of the rolled up envelope material, as well as the corresponding sides of the releasable fastener on the mouth closure. The use of a releasable fastener at the base of the envelope and/or the use of tabs equipped with a releasable fastener at the end tips of the envelope avoids the need for hard plastic clips in the weighted article. Such clips, when used in weighted articles of the type described herein, either cause damage to the article, become unclasped or are uncomfortable to the user when the weighted article is used for exercise.

The additional strength of the weighted article due to the webbing, coatings and closures affords the opportunity to add one or more small pockets to the weighted article. Such pockets have many benefits, in addition to acting as storage areas for personal belongings. For example, tech items such as motion tracking devices may be placed in such pockets. Since current tracking devices are typically made out of stiff plastic or similar materials, conventional sandbags are not able to protect the device. Conventional sandbags are also not able to withstand the abuse caused by the presence of such an object, thereby resulting in damage to the bag.

It will be appreciated that various releasable fasteners may be utilized in the devices and methodologies described herein. These include, but are not limited to, hook-and-loop fasteners, hook-and-pile fasteners, and touch fasteners. Such releasable fasteners will often feature two components which may take the form, for example, of two lineal fabric strips (or, alternatively, round "dots" or squares) which are attached (sewn or otherwise adhered) to the opposing surfaces to be fastened. These releasable fasteners may be provided with varying strengths as dictated by the contemplated end use and fill materials.

Various fabrics may be utilized in the devices disclosed herein. Preferably, the bulk of these materials comprises a tough, flexible material such as, for example, polyester or nylon. However, other suitable materials, such as canvas or various plastics, rubbers, elastomers, or various polymeric materials, may also be utilized.

The devices disclosed herein may have various shapes or configurations. For example, the devices may be polyhedral, ellipsoidal, toroidal, cylindrical, prismatic, spherical, hemispherical, or polygonal. The devices disclosed herein may also be seamed or unseamed, or may have some sides that are seamed and others that are not. By way of example, but not limitation, the device may be polyhedral in shape, and two faces of the polyhedron may be formed by wrapping material across an edge without creating a seam.

For the devices disclosed herein that have seams, these seams may be fortified with additional material or webbing. In some embodiments, this additional material or webbing may extend beyond the seams and may be utilized as, or take the form of, one or more handles. Similarly, this additional material may be utilized to interface the article with one or more accessories. It will be appreciated that, in some embodiments, multiple layers of such additional material or webbing may be provided along the seams or other portions of the device to improve the strength thereof, and these layers may be applied in the same or different directions. For example, these layers may be applied diagonally along one or more surfaces of the device. In some embodiments, these layers may be uniaxially or biaxially oriented (e.g., stretched) to provide additional tensile strength along a particular axis or direction.

Various stitching may be utilized in the devices disclosed herein, especially along any seams thereof. Such stitching may include, but is not limited to, lock stitching and zig-zag stitching.

Various coatings, layers or materials may be applied to, or may form, the inside or outside surfaces or intermediary layers of the articles disclosed herein. These materials may include, for example, silicone, PVC, polyurethane, polyuria, neoprene, various rubbers, and various elastomers. The foregoing materials may be utilized for various purposes including, for example, strengthening, improving the tear resistance, abrasion resistance or puncture resistance of any seams or other portions of the article; preventing or minimizing the ability of the fill material to interact with or damage any seams in the article; preventing or minimizing the ability of the fill material to over-stretch fabric near the seams or to cause threads to cut through the fabric of the article; preventing or minimizing the ability of the fill material to weaken the fabric of the article or to over-stretch the fabric of the article through impact near seams; or creating an air-tight or water-tight boundary.

Various hook-and-loop fasteners may be utilized in the systems and methodologies described herein. Examples of such hook-and-loop fasteners may be found, for example, in the publication entitled "3M Hook And Loop Fasteners", which may be found online at http://multimedia.3 m.com/mws/media/829942O/sj3401-sj3476-sj3522-sj3526n-sj3530-sj3532n-sj3546-sj3571-sj3576.pdf, and which is incorporated herein by reference in its entirety.

For purposes of brevity, a detailed description of some aspects of the devices disclosed herein, such as certain uses or features thereof, has been omitted. However, these details may be found in the following publications produced by the present inventors, all of which are incorporated herein by reference in their entirety:

(a) X-Bag Fast Fill—https://youtu.be/DCrvNik5lH8
(b) X-Bag Fast Empty—https://youtu.be/TzvTovzVuaA
(c) Pancake Fast Fill—https://youtu.be/HOmijOUzOk
(d) Pancake Fast Empty—https://youtu.be/NXrDO_PKluA
(e) Lazy Man Sandbag—50 lb—https://youtu.be/gHrJh4_CUB8

The above description of the present invention is illustrative, and is not intended to be limiting. It will thus be appreciated that various additions, substitutions and modifications may be made to the above described embodiments without departing from the scope of the present invention. Accordingly, the scope of the present invention should be construed in reference to the appended claims. One skilled in the art will appreciate that, in the absent of any teaching to the contrary, the subject matter of any of the claims may be combined with the subject matter of any other claims without departing from the teachings herein, regardless of the dependencies set forth in the claims as originally filed.

APPENDIX A: INDEX OF PARTS

The following is an index of parts associated with the reference numerals used in the drawings herein. In some cases, the description of these parts includes the preferred materials from which these parts may be made. Accordingly, the following index should be construed as illustrative, but not necessarily limiting, with respect to the description of these parts.

100: Interior Volume
101: First Portion—Loop Side
102: Second Portion—Hook Side
103: Protective Rim
104: Bar Tac
105: Zig-Zag Stitch along Rim
106: Protective Rim over Aperture
107: Panels
110: Open Aperture
111: Semi-Closed Aperture (Only Interior Hammock Dam Closure)
112: Fully Closed Aperture (Both Peel and Hammock Dam Closures)
121: Stitch over Hook Feature
122: Zig-Zag Stitch over elastic Loop Neoprene connecting Loop Neoprene to Body
123: Stitch connecting Loop Neoprene to Body Neoprene along edge
124: Hook Feature made of nylon
125: Stretch Loop laminated to Neoprene (or stretch fabric/rubber/other elastic material)
126: Non-Stretch Loop material (or Stretch Loop laminated to Neoprene (or stretch fabric/rubber/other elastic material))
127: Zig-Zag Stitch over eslatic Loop Neoprene connects Loop Neoprene to Body Neoprene
128: Glue Strip
129: Stitch connecting Hook Feature Material to Body Neoprene along body or edge
130: Peel Hook and Loop Connection of 126 Peel Non-Stretch Loop and 124 Hook Feature made of Nylon
131: Hammock Dam Hook and Loop Connection of 125 Non-Stretch Loop and 124 Hook Feature made of Nylon
132: Hammock Dam elastic feature changes shape dynamically with pressure from internal fill material and external people or objects.
135: Hammock Dam Loop Neoprene sewn to inside of 101 First Portion (when fully sewn on, Loop faces toward inside of body)
136: Fabric Side of Hammock Dam Loop Neoprene
140: Fill Material
141: Fill Material Escape Path puts pressure on Hammock Dam, increasing the Shear Bond
150: First Portion Exterior—Hook
151: First Portion Interior—Hook
154: Second Portion Exterior—Loop neoprene hidden—attached to inside of body
155: Second Portion Exterior—Fabric side of Loop neoprene showing—pre-attachment to inside of body
156: Second Portion Interior—Loop side of Loop neoprene showing—pre-attachment to inside of body
160: Abrasion Resistant Fabric Laminated on one or more sides of neoprene
210: Lock Stitch
250: First Portion Exterior—Hook
251: First Portion Interior—Hook
252: Velcro Dam Closure—Open Mouth
254: Second Portion Exterior—Loop neoprene
255: Second Portion Exterior—Structural Webbing along edge
256: Second Portion Interior—Loop neoprene side
258: First Portion Exterior—Hook Section Pulled back to Reveal Envelope
260: Structural Edge Webbing
261: Diagonal Structural Webbing
262: Webbing Extensions
263: Webbing Loop as Handle

264: Small Webbing Loop
265: Loop Velcro
270: Carabineer
271: Dowel Rod
272: Gripping Hand
265: Handle made from Bag material
273: Plastic/Rubber Handle
290: Envelope Fabric
291: Envelope Hook Velcro
292: Envelope Loop Velcro
293: Envelope Hook/Loop End Tip Tabs
294: Envelope Connection Seam to Body of Bag
295: Envelope Open Mouth/Hole
296: Rolling of the Envelope Fabric via multiple rotations—to close is like a dry bag
297: Envelope sealed and ready to Velcro into place and close Velcro Mouth
310: Protective Interior Coating along the rim
311: Protective Interior Coating along the Seam
315: Protective Interior Coating along the inside of the bag
320: Protective Exterior Coating along the rim
321: Protective Exterior Coating along the Seam
325: Protective Exterior Coating across the body of the bag
400: Zipper Closure
410: Lacing Closure
500: Body
600: Weighted Device

What is claimed is:

1. An article, comprising:

a body having first and second opposing walls and housing an interior volume;

a particulate filler disposed in said interior volume;

a dam disposed on an interior surface of said first wall; and a releasable fastener having a first component disposed on a first surface of said dam, and a second component disposed on an interior surface of said second wall opposing said dam; wherein said article is transformable between a first state in which said first and second components of said releasable fastener are spaced apart from each other such that said interior volume is in open communication with the environment external to the article by way of a channel which terminates in an external opening, and a second state in which said first and second components of said releasable fastener are releasably engaged to each other such that said interior volume is closed off from the environment external to said body, wherein said first and second opposing walls are adjoined to each other along a peripheral seam, and wherein said first component of said releasable fastener includes a first portion disposed on said first surface of said dam, and a second portion disposed in said channel adjacent to said external opening.

2. The article of claim 1, wherein said article is transformable between said first and second states by applying force in a direction perpendicular to said first surface of said dam.

3. The article of claim 1, wherein said releasable fastener is a hook-and-loop fastener.

4. The article of claim 1, wherein said channel has a longitudinal axis, and wherein said first surface of said dam extends along said longitudinal axis.

5. The article of claim 4, wherein said dam forms a region that is open on a single side which faces away from said opening to the external environment.

6. The article of claim 5, wherein the dynamic internal pressure from the fill material increases the bond between the first and second components of the releasable fastener when the article is in the second state through shearing bond strength.

7. The article of claim 1, wherein said channel has a longitudinal axis, and wherein said dam is concave in the direction of a vector extending from said interior volume to said channel.

8. The article of claim 5, wherein said channel has a longitudinal axis, and wherein said dam is U-shaped in a cross-section taken in a plane containing said longitudinal axis and perpendicular to said first surface of said dam.

9. The article of claim 1, wherein said first and second portions of said first component of said releasable fastener releasably engage said second component of said releasable fastener when said article is in said second state.

10. The article of claim 1, further comprising a first protective rim which is disposed about the periphery of said first and second opposing walls.

11. The article of claim 1, further comprising a second protective rim which is disposed about the periphery of said opening.

12. The article of claim 1, wherein said article is an ellipsoid or a parallel-piped.

13. The article of claim 1, further comprising:

a handle which extends from said body.

14. The article of claim 1, further comprising a portion of webbing which extends about a peripheral surface of said device.

15. The article of claim 1, wherein said article is a parallel-piped, and further comprising a portion of webbing which extends diagonally across a parallelogram on the surface of said device.

16. A method for creating a weighted article, comprising:

providing an article having (a) first and second opposing walls and housing an interior volume, (b) a dam disposed on an interior surface of said first wall; and (c) a releasable fastener having a first component disposed on a first surface of said dam, and a second component disposed on an interior surface of said second wall opposing said dam, wherein said article is transformable between a first state in which said first and second components of said releasable fastener are spaced apart from each other such that said interior volume is in open communication with the environment external to the article by way of a channel which terminates in an external opening, and a second state in which said first and second components of said releasable fastener are releasably engaged to each other such that said interior volume is closed off from the environment external to said body, and wherein said first component of said releasable fastener includes a first portion disposed on said first surface of said dam, and a second portion disposed in said channel adjacent to said external opening;

positioning the article in the first state;

adding a particulate filler to the internal volume by way of the channel and opening; and transforming the article to the second state.

17. The method of claim 16, wherein said first and second opposing walls are adjoined to each other along a peripheral seam.

18. An article, comprising:

a body having first and second opposing walls and housing an interior volume;

a particulate filler disposed in said interior volume;

a dam disposed on an interior surface of said first wall; and a releasable fastener having a first component disposed on a first surface of said dam, and a second component disposed on an interior surface of said second wall opposing said dam; wherein said article is an ellipsoid and is transformable between a first state in which said first and second components of said releasable fastener are spaced apart from each other such that said interior volume is in open communication with the environment external to the article by way of a channel which terminates in an external opening, and a second state in which said first and second components of said releasable fastener are releasably engaged to each other such that said interior volume is closed off from the environment external to said body, wherein said first component of said releasable fastener includes a first portion disposed on said first surface of said dam, and a second portion disposed in said channel adjacent to said external opening.

19. The article of claim 18, wherein said first and second opposing walls are adjoined to each other along a peripheral seam.

20. The article of claim 18, wherein said channel has a longitudinal axis, wherein said first surface of said dam extends along said longitudinal axis, wherein said dam forms a region that is open on a single side which faces away from said opening to the external environment, and wherein said dam is U-shaped in a cross-section taken in a plane containing said longitudinal axis and perpendicular to said first surface of said dam.

* * * * *